US011964196B2

(12) United States Patent
Haiola et al.

(10) Patent No.: US 11,964,196 B2
(45) **Date of Patent: *Apr. 23, 2024**

(54) INTERCHANGEABLE MOUTH SHIELD

(71) Applicant: Katoa Corp., Yorba Linda, CA (US)

(72) Inventors: Sione Haiola, Chino Hills, CA (US); Shazia Peshimam, Fullerton, CA (US)

(73) Assignee: Katoa Corp., Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/667,878

(22) Filed: Feb. 9, 2022

(65) Prior Publication Data

US 2022/0249939 A1 Aug. 11, 2022

Related U.S. Application Data

(63) Continuation of application No. 16/400,380, filed on May 1, 2019, now Pat. No. 11,291,905.

(60) Provisional application No. 62/665,948, filed on May 2, 2018.

(51) Int. Cl.
*A63B 71/08* (2006.01)

(52) U.S. Cl.
CPC ..... *A63B 71/085* (2013.01); *A63B 2071/088* (2013.01)

(58) Field of Classification Search
CPC ..... A63B 71/08–10; A61F 5/56–58; A61M 16/0488–0497; A61C 9/00; A61C 9/006; A61C 9/0013; A61C 7/00
See application file for complete search history.

(56) References Cited

U.S. PATENT DOCUMENTS

| | | | | |
|---|---|---|---|---|
| 3,139,088 | A | 6/1964 | Galleher, Jr. | |
| 3,692,025 | A | 9/1972 | Greenberg | |
| 5,165,423 | A * | 11/1992 | Fowler | G10K 5/00 446/202 |
| 5,720,302 | A | 2/1998 | Belfer | |
| 6,068,475 | A | 5/2000 | Stoyka | |
| 6,269,816 | B1 | 8/2001 | Rigonatti et al. | |
| 6,494,210 | B1 | 12/2002 | Mams | |
| 6,675,802 | B1 | 1/2004 | Thornton | |
| 8,074,658 | B2 | 12/2011 | Kittelsen | |
| D663,485 | S | 7/2012 | Turkbas et al. | |
| D663,486 | S | 7/2012 | Turkbas et al. | |

(Continued)

FOREIGN PATENT DOCUMENTS

EP 1525857 A1 4/2005

OTHER PUBLICATIONS

"Fluoride treatments in the dental office," JADA, vol. 138, Mar. 2007.

(Continued)

*Primary Examiner* — Michelle J Lee
(74) *Attorney, Agent, or Firm* — Knobbe, Martens, Olson & Bear, LLP

(57) ABSTRACT

The interchangeable mouth shields disclosed herein include a lip-anterior portion and teeth tray that can be releasably coupled together. The lip-anterior portion includes a panel positioned anterior to a lip shield. The panel can be customized to be different shapes and have decorative features. The interchangeable mouth shield includes a vent enabling a user to breathing through the interchangeable mouth shield during use. The teeth tray can be selectively flavored.

12 Claims, 25 Drawing Sheets

(56) References Cited

U.S. PATENT DOCUMENTS

| | | | | |
|---|---|---|---|---|
| 8,800,184 | B1 | 8/2014 | Lerman et al. | |
| 8,931,488 | B2 | 1/2015 | Evans et al. | |
| D734,556 | S | 7/2015 | Brett et al. | |
| 9,375,289 | B1 | 6/2016 | Walls | |
| D760,889 | S | 7/2016 | Evans et al. | |
| 9,526,669 | B1 | 12/2016 | McCall | |
| D790,712 | S | 6/2017 | Walls | |
| 9,687,722 | B2 | 6/2017 | Kennedy | |
| 9,770,643 | B2 | 9/2017 | Hawkins | |
| D841,257 | S | 2/2019 | Turkbas | |
| D857,301 | S | 8/2019 | Turkbas | |
| D876,728 | S | 2/2020 | Evans et al. | |
| D885,583 | S | 5/2020 | Hailo et al. | |
| D912,827 | S | 3/2021 | Hailo et al. | |
| 11,291,905 | B2 * | 4/2022 | Haiola | A63B 71/085 |
| 2006/0174897 | A1 | 8/2006 | Sarkisian | |
| 2013/0081640 | A1 | 4/2013 | Herman et al. | |
| 2013/0087157 | A1 | 4/2013 | Hawkins | |
| 2013/0104913 | A1 | 5/2013 | Evans et al. | |
| 2013/0220333 | A1 | 8/2013 | Morris | |
| 2014/0261465 | A1 | 9/2014 | Turkbas | |
| 2014/0276171 | A1 | 9/2014 | Hestness et al. | |
| 2014/0345626 | A1 | 11/2014 | Brett et al. | |
| 2014/0366892 | A1 | 12/2014 | Mauro | |
| 2015/0051646 | A1 * | 2/2015 | Chan | A61J 17/02 606/236 |
| 2017/0042725 | A1 | 2/2017 | Smith | |
| 2017/0209300 | A1 * | 7/2017 | Radmand | A61M 16/0816 |
| 2017/0296901 | A1 | 10/2017 | Evans et al. | |
| 2018/0280785 | A1 * | 10/2018 | Circo | A63B 71/085 |
| 2020/0047056 | A1 | 2/2020 | Wilson | |

OTHER PUBLICATIONS

Nike, Nike Hyperflow Flavored Lip Protector, https://www.dickssportinggoods.com/p/nike-hyperflow-black-raspberry-flavored-lip-protector-16nikunkhyprflwlpspma/16nikunkhyprflwlpspma.

Nike, Nike Hyperflow Flavored Lip Protector, available as early as Mar. 21, 2017, 4 pages, https://web.archive.org/web/20170321094413/https://www.dickssportinggoods.com/p/nike-hyperflow-black-raspberry-flavored-lip-protector-16nikunkhyprflwlpspma/16nikunkhyprflwlpspma.

SafeTGard , Fuelgard™ Mouthguard Kit With Electrolyte Tablets, https://safetgard.myshopify.com/products/fuelgard-mouthguard-with-electrolytes.

SafeTgard, Fuelgard™ Mouthguard Kit With Electrolyte Tablets, accessed Apr. 27, 2018, 2 pages, https://safetgard.myshopify.com/products/fuelgard-mouthguard-with-electrolytes.

Shock Doctor Interchange, accessed Jul. 24, 2019 retrieved from internet, <https://www2.shockdoctor.com/interchange/>.

Shock Doctor, Shock Doctor Interchange Lip Guard Shield, available as early as Apr. 26, 2018, 1 page, https://www.shockdoctor.com/collections/mouthguards/sports.

* cited by examiner

INTERCHANGEABLE MOUTH SHIELD

INCORPORATION BY REFERENCE TO ANY PRIORITY APPLICATIONS

This application is a continuation of U.S. application Ser. No. 16/400,380, filed May 1, 2019, which claims the priority benefit of U.S. Application No. 62/665,948, filed May 2, 2018, which are hereby incorporated by reference in their entireties herein.

Any and all applications for which a foreign or domestic priority claim is identified in the Application Data Sheet as filed with the present application are hereby incorporated by reference under 37 C.F.R. § 1.57.

BACKGROUND

Mouthguards are used in athletics and other physical activities to protect the teeth and mouth area of a user from damaging impact. Current mouthguards can be expensive to buy and replace, have an unpleasant taste, and/or make breathing difficult. Current mouthguards can also be aesthetically displeasing. For example, some current mouthguards incorporate a shield to protect the mouth area of a user which can resemble a pacifier. This can be a source of embarrassment for the user, especially for children. Accordingly, for at least the reasons above, athletes and other users often forego using a mouthguard. This, however, is dangerous because without such protection athletes and other users can incur significant injuries. Mouthguard solutions that solve at least these problems are desirable.

SUMMARY

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No individual aspects of this disclosure are essential or indispensable.

The interchangeable mouth shields disclosed herein addresses at least the problems outlined above. The interchangeable mouth shields disclosed herein include two separate components—a lip-anterior portion and a teeth tray. In some embodiments disclosed herein, the lip-anterior portion includes an elongate arm and mating portion that cooperate to releasably couple the mating portion with an engagement surface of the teeth tray. Accordingly, the lip-anterior portion can easily couple to and decouple from the teeth tray. This can enable a user to buy and replace either the lip-anterior portion or teeth tray, as needed, without needing to buy an entirely new interchangeable mouth shield. This can reduce the cost for a user. This can reduce waste by enabling users to only replace the component that needs to be replaced. This can also make manufacturing more efficient.

The teeth trays disclosed herein include a surface or bite pad that can be selectively flavored to a user's preferences. This can help eliminate or reduce the unpleasant taste and thirst that frequently accompanies mouthguard use. The interchangeable mouth shields disclosed herein include vents that enable a user to breathe through the interchangeable mouth shield during use. This can make breathing easier for the user, while remaining protected.

In some embodiments disclosed herein, the lip-anterior portion includes a panel positioned in front of a lip shield. The panel can be customized to have different shapes, such as a team logo, animal profile, text, shapes, and/or other features, while the lips and/or mouth area of a user are primarily protected by the lip shield. The panel can be further customized with printing, decals, stickers, painting, and/or other decorative methods. Additionally, a user can use different lip-anterior portions with a single teeth tray to alter styles as desired. This can enable a user to adapt the interchangeable mouth shield to the user's preferences, making the interchangeable mouth shield more aesthetically pleasing to the user and others. This can reduce any embarrassment that the user may have felt when using a mouthguard and even make the interchangeable mouth shield desirable and/or add an element of collectability to the product.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure.

DETAILED DESCRIPTION

Although certain embodiments and examples are described below, this disclosure extends beyond the specifically disclosed embodiments. Thus, it is intended that the scope of this disclosure should not be limited by any particular embodiments described below.

Figure 1A:
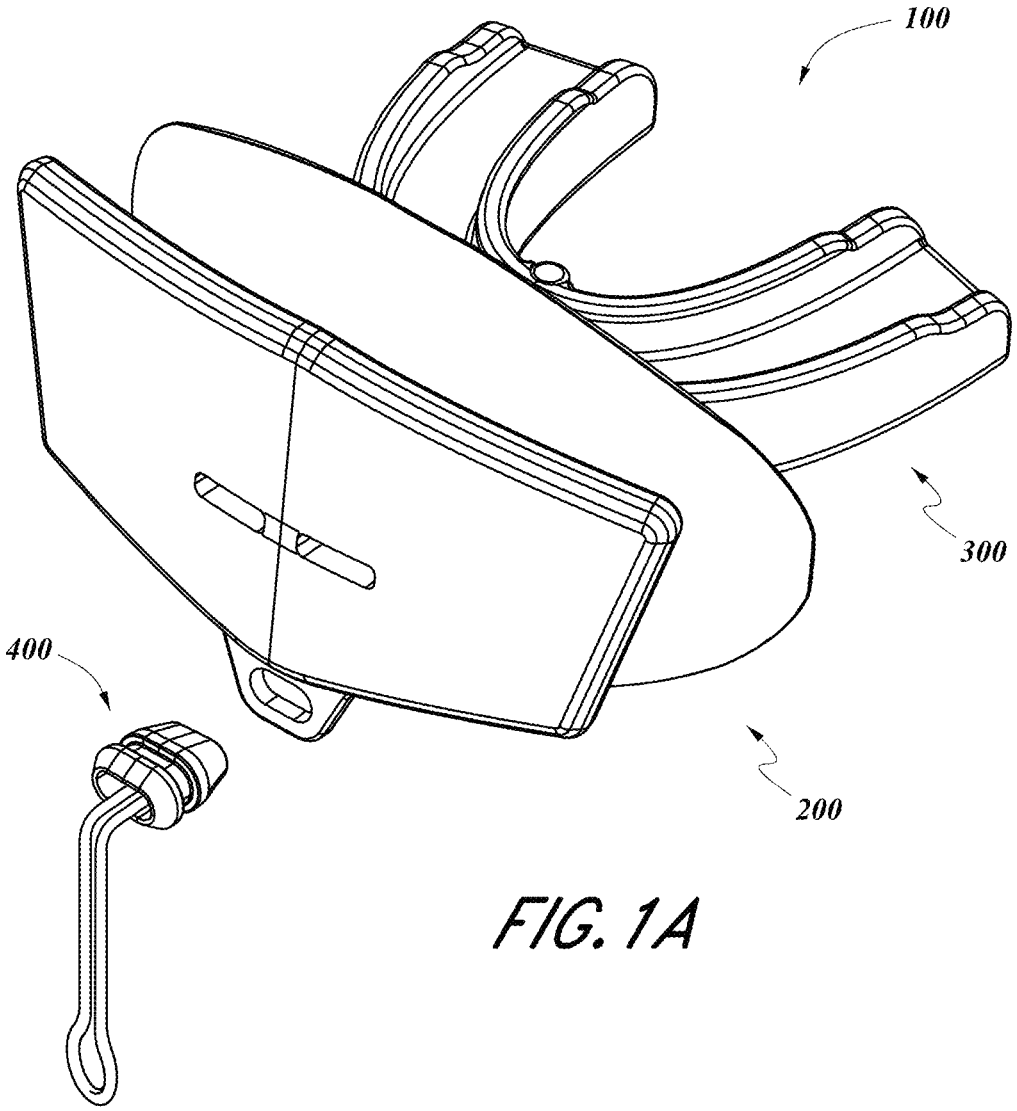
FIG. 1A illustrates an interchangeable mouth shield in an assembled configuration.

FIG. 1A illustrates an assembled interchangeable mouth shield 100. The interchangeable mouth shield 100 has a lip-anterior portion 200. The interchangeable mouth shield 100 has a teeth tray 300. In an assembled state, the lip-anterior portion 200 is positioned in front of and releasably coupled to the teeth tray 300. The teeth tray 300, in use, is positioned within the mouth of a user to protect a user's teeth. The lip-anterior portion 200, in use, is positioned in front of a user's lips and protects a user's lips and/or mouth area.

The interchangeable mouth shield 100, as shown in FIG. 1A, has a clip 400. The clip 400 is coupled to a tether and can interface with the lip-anterior portion 200. The clip 400 and tether can be used to tether the interchangeable mouth shield 100 and/or the lip-anterior portion 100 to a portion of a helmet, such as a face mask, or other objects.

Figure 1B:
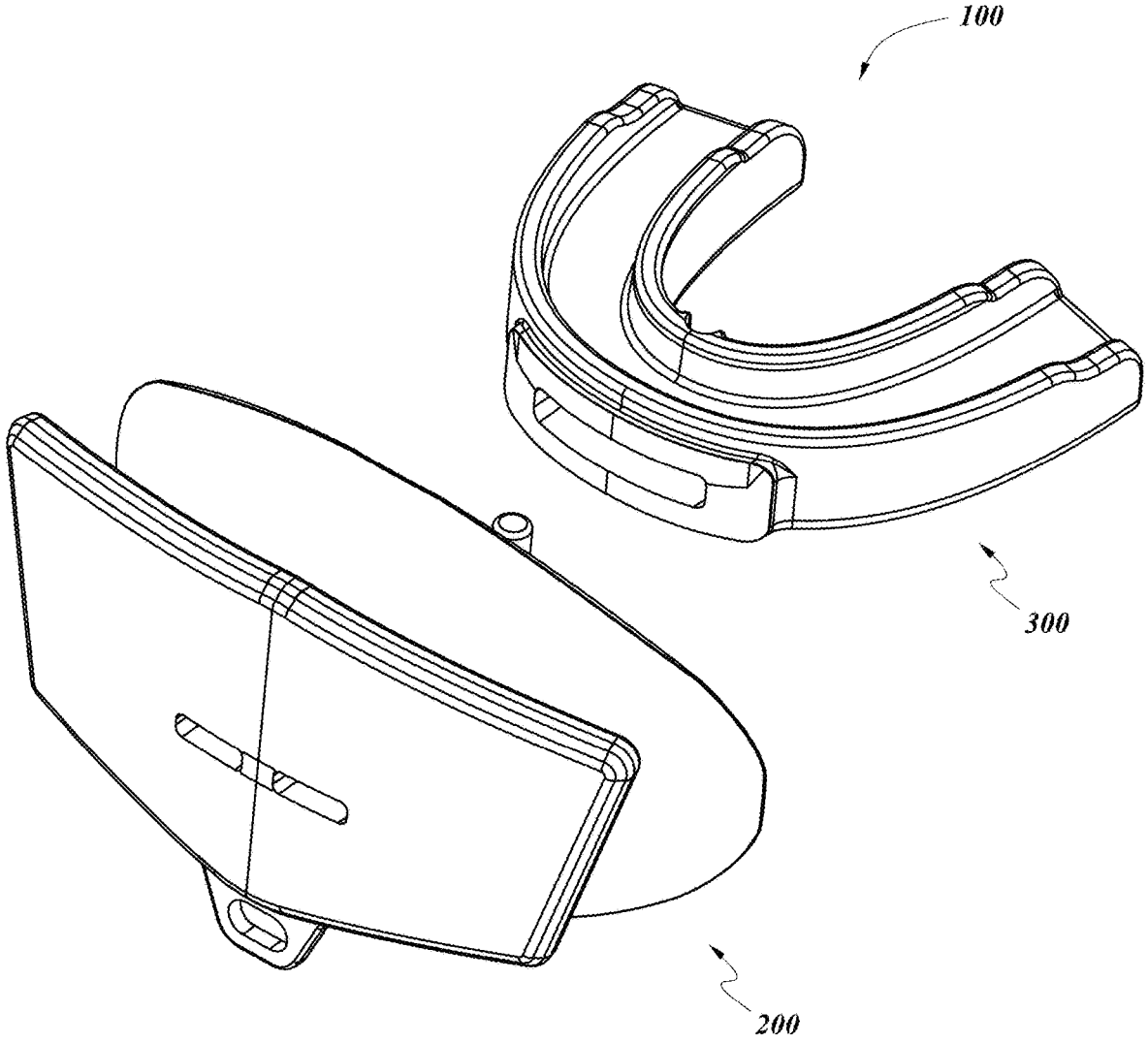
FIG. 1B illustrates the interchangeable mouth shield shown in FIG. 1A in a disassembled configuration.

FIG. 1B illustrates the interchangeable mouth shield 100 in a disassembled state. The lip-anterior portion 200 is separated from the teeth tray 300. The ability to assemble and disassemble the interchangeable mouth shield 100 can advantageously enable a user to substitute components that need to be replaced due to damage and/or to cater to a user's preferences, such as preferred aesthetics, comfort, and/or mouth protection. Interchangeability can advantageously enable a user to replace either the lip-anterior portion 200 and/or teeth tray 300 as needed or desired. For example, the teeth tray 300 may need to be replaced due to wear from contact with the teeth and saliva of the user or for sanitation purposes. The damaged teeth tray 300 can be replaced with a new teeth tray 300, enabling a user to continue to use the same lip-anterior portion 200 with the interchangeable mouth shield 100. This can reduce replacement cost and waste production by enabling a user to simply use a new teeth tray 300, just one component, rather than an entirely new interchangeable mouth shield 100. In another example, the user can couple different lip-anterior portions 200 to the teeth tray 300 to enable a user to selectively use lip-anterior portions 200 with varied sizes and styles, providing various levels of protection, aesthetics, and/or fits. In some embodiments, the interchangeable mouth shield 100 is a single integrated unit, without the ability to assemble and disassemble. In some embodiments, the lip-anterior portion 200 and teeth tray 300 are permanently coupled.

Figure 2A:
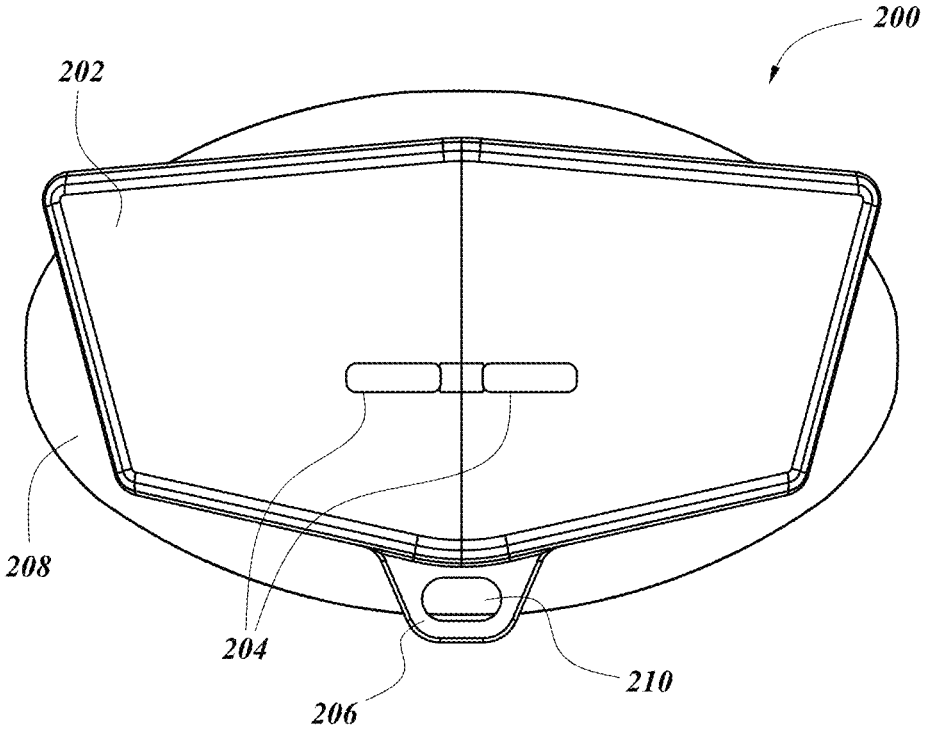
FIG. 2A illustrates a front view of the lip-anterior portion of the mouth shield shown in FIG. 1A.

FIGS. 2A-2E illustrate various views of the lip-anterior portion 200. As shown in FIG. 2A, the lip-anterior portion 200 has a panel 202. The panel 202, as illustrated, has a shield shape. The panel 202 can be customized to have various shapes to cater to different user's stylistic preferences, desired comfort, and/or needed protection coverage. For example, the panel 202 can be in the shape of a circle, oval, polygon, logo, text (such as a message, team name, etc.), athletic equipment (such as a football, etc.), animal profile, and/or other shapes. The panel 202 can be any color. The panel 202 can be further customized and personalized by enabling a user and/or manufacturer to apply different designs on the front surface of the panel 202, which can include using printing, decals, stickers, painting, and/or other decorative methods. This can advantageously encourage users, especially young users, to use the interchangeable mouth shield 100 to avoid injury.

Figure 2B:
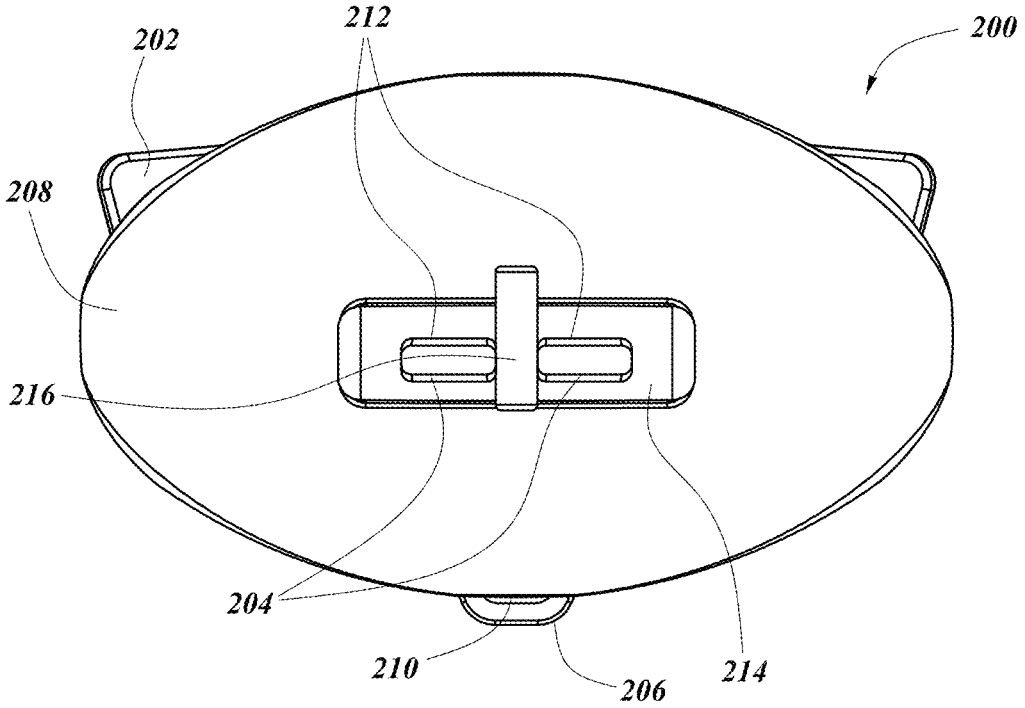
FIG. 2B illustrates a back view of the lip-anterior portion of the mouth shield shown in FIG. 1A.

The lip-anterior portion 200, as shown in FIG. 2A, has a lip shield 208. The lip shield 208 is positioned posterior to the panel 202. The lip shield 208 protects the lips and/or mouth area of a user. The lip shield 208 has an oval shape. The lip shield 208 can be a variety of shapes and sizes to cater to different user's preferences and sizes, which can include circular, polygonal, and/or other suitable shapes. The lip shield 208 posteriorly curves, as shown in FIG. 2D, to contact or be proximate to the surrounding portions of the user's mouth, which can create an ergonomic fit. The lip shield 208 can include varying radiuses of curvatures to accommodate different users.

The panel 202, as shown in FIG. 2D, is offset from the lip shield 208. A connector portion 218 extends between the lip shield 208 and the panel 202. In some embodiments, offsetting the panel 202 from the lip shield 208 can advantageously enable the panel 202 to be a variety of shapes while the lip shield 208 ensures that the mouth area of the user is protected. In some embodiments, offsetting the panel 202 from the lip shield 208 can advantageously increase shock absorbance. For example, the panel 202, connector portion 218, and/or lip shield 208 can cooperate to absorb a force of impact applied to a user's mouth area. This can reduce a user's risk of injury. In some embodiments, the panel 202, connector portion 218, and/or lip shield 208 is/are sized to reduce the likelihood that the user will unintentionally catch the panel 202, connector portion 218, and/or lip shield 208 on features of a helmet, such as a face mask, and/or other objects.

Returning to FIG. 2A, the panel 202 has a clip interface 206. The clip interface 206 is positioned on or proximate a bottom edge of the panel 202. The clip interface 206 has a receiving aperture 210 that interfaces with the clip shown in FIGS. 4A-4D. In some embodiments, the clip interface 206 can be positioned on other portions of the panel 202 or lip-anterior portion 200. In some embodiments, the clip interface 206 includes curves that can increase the structural integrity of the lip-anterior portion 200 and/or reduce the likelihood that the clip interface 206 will inadvertently catch onto objects.

The panel 202, as shown in FIG. 2A, has a pair of front vent apertures 204. The pair of front vent apertures 204 are, as shown in FIG. 2B, connected via a vent to a pair of back vent apertures 212. This enables air to flow through the entirety of the lip-anterior portion 200. The pair of front vent apertures 204 are smaller than the pair of back vent apertures 212. In some embodiments, the pair of front vent apertures 204 are bigger than the pair of back vent apertures 212. In some embodiments, the pair of front vent apertures 204 and the pair of back vent apertures 212 are the same size.

Figure 2C:
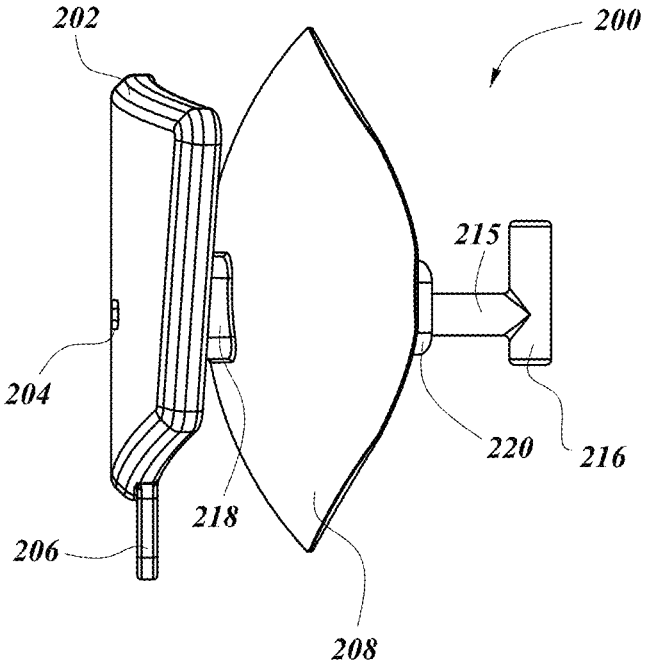
FIG. 2C illustrates a side view of the lip-anterior portion of the mouth shield shown in FIG. 1A.
Figure 2D:
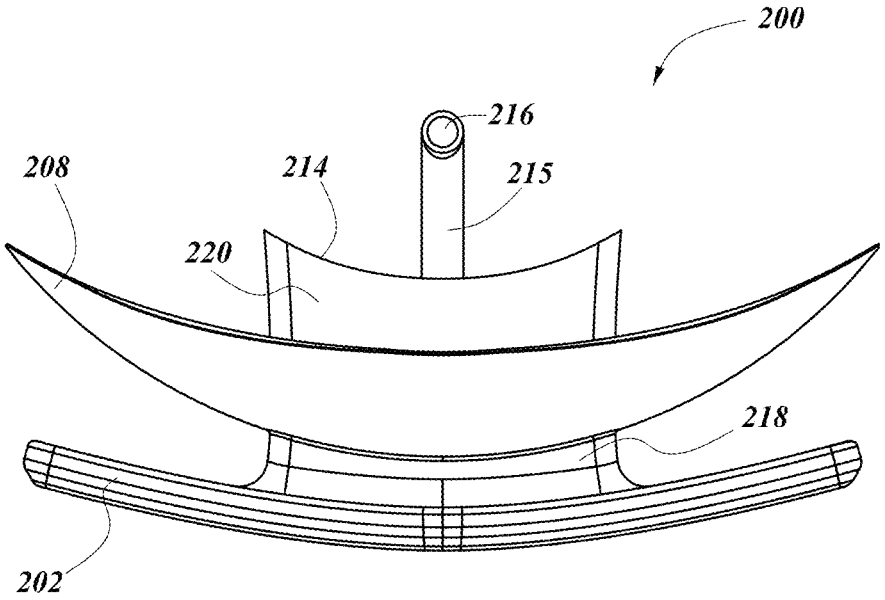
FIG. 2D illustrates a top view of the lip-anterior portion of the mouth shield shown in FIG. 1A.
Figure 2E:
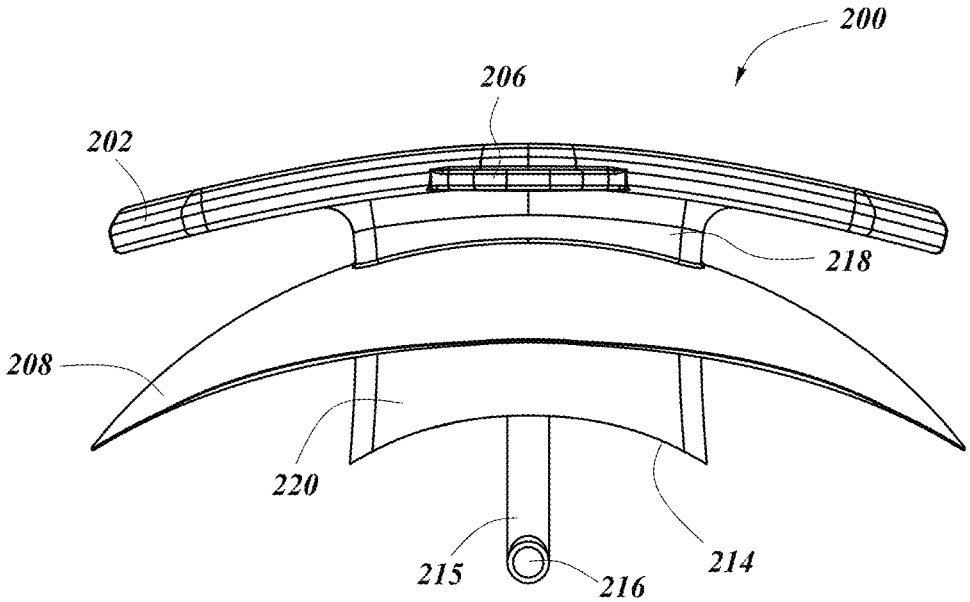
FIG. 2E illustrates a bottom view of the lip-anterior portion of the mouth shield shown in FIG. 1A.

The lip-anterior portion 200, as shown in FIG. 2D, includes a bridge 220 coupled to a rear surface of the lip shield 208. The bridge 220 extends posteriorly away from the lip shield 208. The bridge 220 has a rectangular cross-section with rounded edges. In some embodiments, the bridge 220 has a circular, polygonal, or other suitably shaped cross-section. The bridge 220 offsets the lip-anterior portion 220 from the teeth tray 300, as shown in FIG. 3F. The free end of the bridge 220 has a contact surface 214. The contact surface 214 is curved to interface with the teeth tray 300. As shown in FIG. 2B, the pair of back vent apertures 212 are positioned on the bridge 220 and surrounded by the contact surface 214. In some embodiments, the bridge 220 helps to absorb forces applied to the interchangeable mouth shield 100 such that a user is less likely to be injured.

FIG. 2C shows an elongate arm 215 that extends posteriorly away from the bridge 220. The elongate arm 215, as shown in FIG. 2B, is positioned between the pair of back apertures 212 and surrounded by the contact surface 214. Returning to FIG. 2C, the elongate arm 215 is cylindrical. In some embodiments, the elongate arm 215 can have a cross-sectional shape that is an oval, polygon, irregular, and/or another suitable shape.

A mating portion 216, as shown in FIG. 2C, is positioned on a free end of the elongate arm 215. The mating portion 216 is cylindrical. The mating portion 216 is perpendicular to a longitudinal axis of the elongate arm 215. The mating portion 216 is elongate, having a longitudinal axis that is perpendicular to a longitudinal axis of the elongate arm 215. A longer portion of the mating portion 216 is positioned above the joint between the elongate arm 215 and the mating portion 216 than below. The mating portion 216 and elongate arm 215 have the same or similar cross-sectional sizes. In some embodiments, the mating portion 216 can have a cross-sectional shape that is an oval, polygon, irregular, and/or anther suitable shape.

Figure 3A:
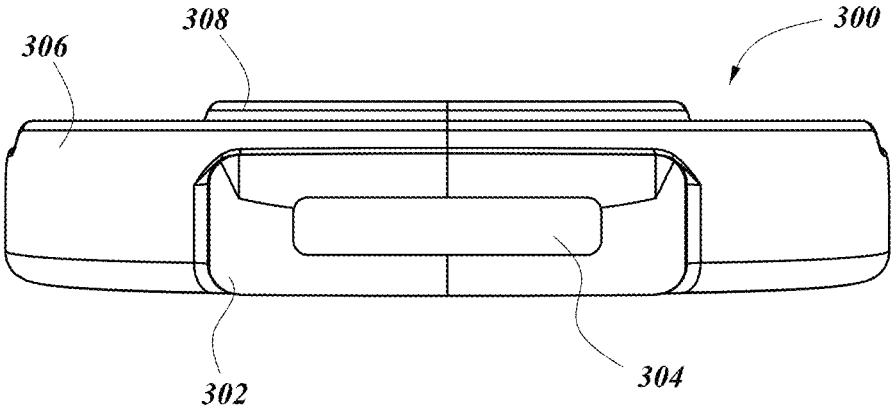
FIG. 3A illustrates a front view of the teeth tray of the mouth shield shown in FIG. 1A.
Figure 3B:
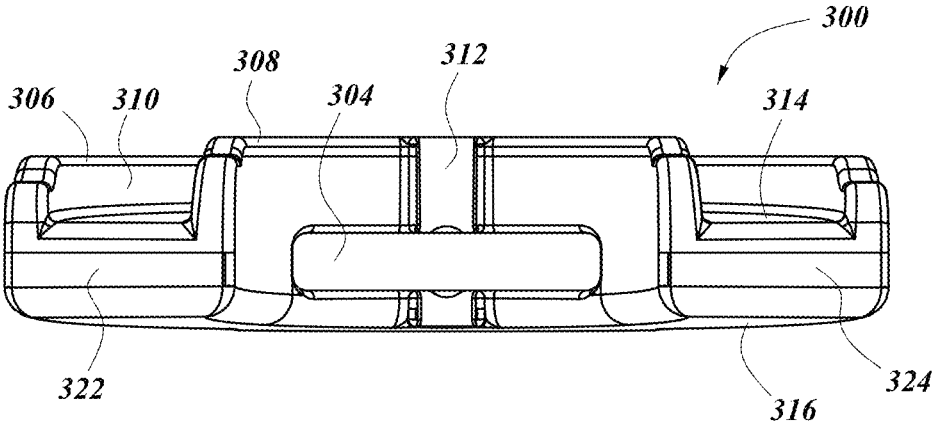
FIG. 3B illustrates a back view of the teeth tray of the mouth shield shown in FIG. 1A.
Figure 3C:
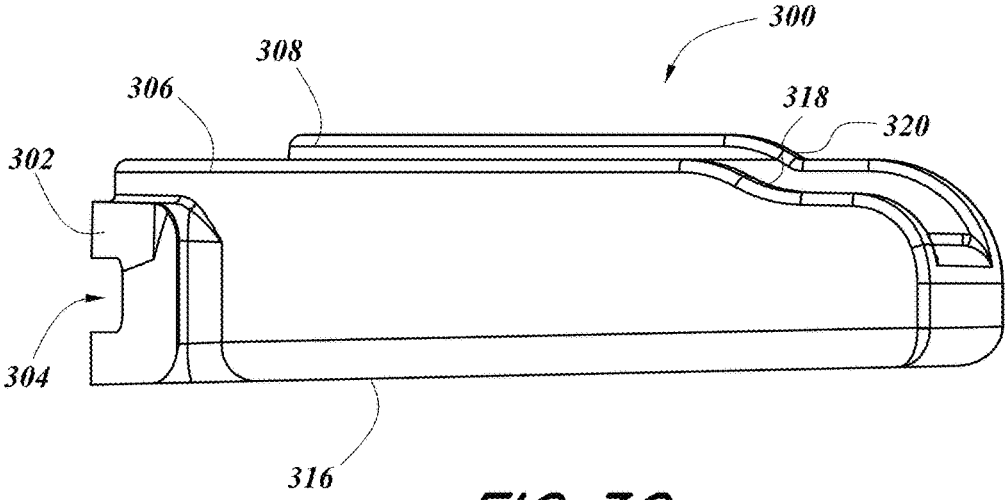
FIG. 3C illustrates a side view of the teeth tray of the mouth shield shown in FIG. 1A.
Figure 3D:
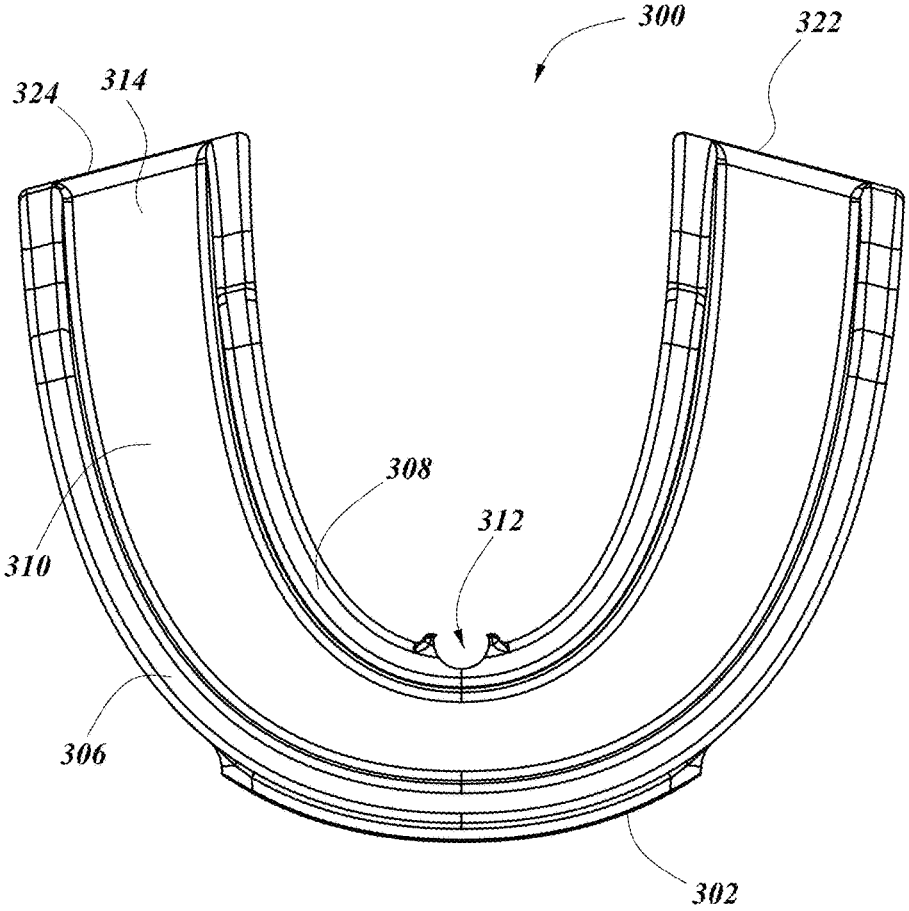
FIG. 3D illustrates a top view of the teeth tray of the mouth shield shown in FIG. 1A.

FIGS. 3A-3E illustrate various views the teeth tray 300. As shown in FIG. 3A, the teeth tray 300 has an outer wall 306 and an inner wall 308. The outer wall 306 extends to a lower elevation than the inner wall 308. As shown in FIG. 3B, the outer wall 306 is offset from the inner wall 308. The outer wall 306 and the inner wall 308 have the same or similar thickness. In some embodiments, the outer wall 306 and the inner wall 308 have different thicknesses. As shown in FIG. 3D, the outer wall 306 and the inner wall 308 are u-shaped. The outer wall 306 being longer and having a larger radius of curvature than the inner wall 308. The outer wall 306 and the inner wall 308 protect the lateral surfaces of a user's teeth when the teeth tray 300 is placed in a user's mouth and receives the teeth of the user. The outer wall 306 and the inner wall 308 can help position the teeth tray 300 in the mouth of a user and/or prevent the teeth tray 300 from shifting during use.

The teeth tray 300, as shown in FIG. 3A, has an aperture 304. The aperture 304 extends through the teeth tray 300, as shown in FIG. 3B, such that air can travel through the teeth tray 300. The aperture 304 has a size such that the pair of back vent apertures 212 on the lip-anterior portion 200 are at least partially or entirely positioned within the perimeter of the aperture 304 when the lip-anterior portion 200 is coupled to the teeth tray 300. This enables air to travel through the entirety of the interchangeable mouth shield 100 when assembled. This advantageously enables a user to breathe through the interchangeable mouth shield 100 while engaged with a user's mouth. This can enable users to breathe easier which can encourage use of the interchangeable mouth shield 100, thereby reducing injuries common for foregoing mouth protection. In some embodiments, the user can use the teeth tray 300 without coupling to the lip-anterior portion 200, this can enable a user to breathe directly through the aperture 304.

The teeth tray 300 has a receiving surface 302, as shown in FIG. 3A. The receiving surface 302 surrounds the aperture 304. The receiving surface 302, as shown in FIG. 3C, extends away from the front surface of the teeth tray 300 and/or the outer wall 306. The receiving surface 302 contacts the contact surface 214 of the lip-anterior portion 200 when the interchangeable mouth shield 100 is assembled. The receiving surface 302 is curved with the same or similar radius of curvature of the outer wall 306. The curve of the receiving surface 302 and the curve of the contact surface 214 are complimentary such that, when the interchangeable mouth shield 100 is assembled, the receiving surface 302 is flush with the contact surface 214. In some embodiments, the receiving surface 302 does not extend away from the front surface of the teeth tray 300 and/or the outer wall 306 but is coplanar with surrounding portions of the front surface of the teeth tray 300 and/or the outer wall 306.

As shown in FIG. 3B, a channel 310 is positioned between the outer wall 306 and the inner wall 308. The channel 310 has a surface 314 that defines a bottom of the channel 310. The channel 310 expands the distance between the outer wall 306 and the inner wall 308. The channel 310, as shown in FIG. 3D, is u-shaped. The channel 310 receives the teeth of a user when the teeth tray 300 is placed into the user's mouth. The channel 310 is narrower near the anterior portion of the teeth tray 300 than at the posterior portion of the teeth tray 300. This accommodates the narrower teeth that are anteriorly positioned in a user's mouth and the wider teeth that are posteriorly positioned in a user's mouth.

The surface 314 can be made of a soft material that enables a user to comfortably bite into the surface 314, securing the interchangeable mouth shield 100. The surface 314 can have flavoring absorbers, which can be surface features such as perforations or texturing that provide better retention of flavoring. A flavoring gel, liquid, and/or other substance can be selectively applied to the flavoring absorbers to enable a user or manufacturer to apply different flavors. In some embodiments, the surface 314 can include an integrated bite pad that is manufactured separately and then coupled to the surface 314. The bite pad can be permanently bonded to the surface 314. The integrated bite pad can be made of a soft material, that promotes user comfort. The integrated bite pad can include a gel, such that adjusts to the contours of a user's mouth. The integrated bite pad can absorb flavors from a flavoring gel, liquid, and/or other substance. The integrated bite pad can have flavoring absorbers the same as or similar to the features described above. The integrated bite pad can include a soft material that can interface with the teeth of a user. In some embodiments, the surface 314 and/or channel 310 can receive a separate bite pad, which can be selectively flavored. Separate bite pads can be substituted in with different flavor. The separate bite pads can be flavored tabs. Separate bite pads can be substituted in as needed due to wear, loss of flavor, sanitation, and/or other reasons. The separate bite pads can include gel, that can be flavored. The separate bite pads can absorb a flavoring gel, liquid, or other substance. The separate bite pads can be made of a soft material that interfaces with a user's teeth.

The teeth tray 300 has an engagement surface 312, as shown in FIG. 3B. The engagement surface 312 is positioned, at least partially, on an outer surface of the inner wall 308. The engagement surface 312 extends above and below the aperture 304. The engagement surface 312, as shown in FIG. 3D, is curved such that the engagement surface 312 can receive the mating portion 216 of the lip-anterior portion 200. In some embodiments, the engagement surface 312 is positioned at and/or proximate an inflection point of the outer surface of the inner wall 308. The engagement surface 312 includes ridges and/or extrusions at peripheries of the engagement surface, that extend away from the inner wall 308, to securely couple the mating portion 216 to the engagement surface 312. In some embodiments, the engagement surface 312 can form a press fit or snap-fit with the mating portion 216.

The teeth tray 300, as shown in FIGS. 3B and 3C, has a first end 322 and a second end 324. The surface 312, outer wall 306, and inner wall 308 include curved transitions to the first end 322 and second end 324, promoting user comfort. When viewed from a top perspective, as shown in FIG. 3D, the first end 322 and the second end 324 include surfaces that are obtusely angled relative to each other. This can accommodate the posterior portions of a user's mouth, promoting comfort. In some embodiments, when viewed from a top perspective, the first end 322 and the second end 324 include surfaces that are not angled relative to each other but, instead, are coplanar.

Figure 3E:
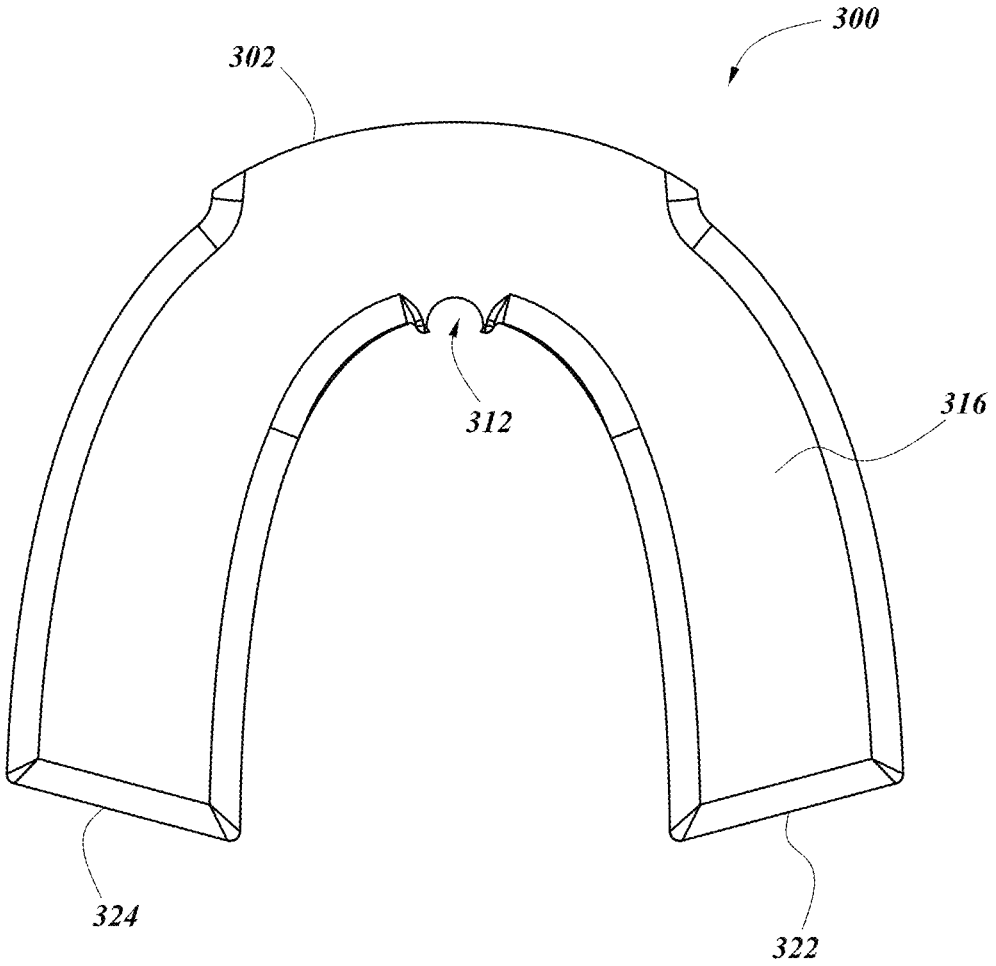
FIG. 3E illustrates a bottom view of the teeth tray of the mouth shield shown in FIG. 1A.
Figure 3F:
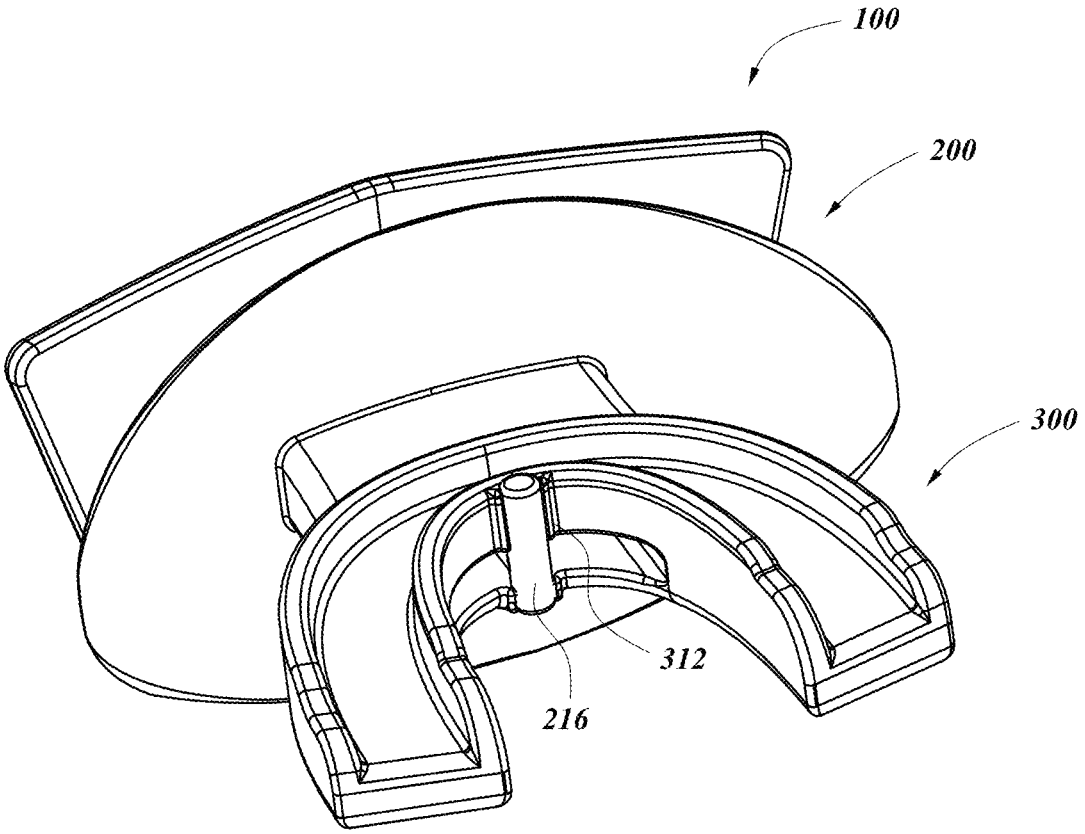
FIG. 3F illustrates a rear view of the interchangeable mouth shield shown in FIG. 1A in an assembled configuration.

The teeth tray 300 includes a bottom surface 316, as shown in FIG. 3E. The bottom surface 316 can be generally u-shaped when the teeth tray 300 is viewed from a bottom perspective. As shown in FIG. 3C, the bottom surface 316 is flat or substantially flat. In some embodiments, the bottom surface 316 includes a curved profile when viewed from the side. The bottom surface 316 can engage with the bottom teeth of a user when a user bites down on the teeth tray 300. In some embodiments, the bottom surface 316 is made of a soft material that is suitable to engage the teeth of the user. The bottom surface 316 and the surface 314, as shown in FIG. 3B, are angled relative to each other. The distance between the surface 316 and the surface 314 is greater at an anterior portion of the teeth tray 300 than at a posterior portion of the teeth tray 300. This can accommodate the contours and shape of a user's mouth and/or teeth.

As shown in FIG. 3C, the outer wall 306 includes an outer contour 318. The outer contour 318 transitions between a higher elevation and lower elevation of the outer wall 318. This can advantageously accommodate the posterior region of a user's mouth, promoting comfort. The inner wall 308 includes an inner contour 320. The inner contour 320 transitions between a higher elevation and lower elevation of the inner wall 308. This can advantageously accommodate the posterior region of a user's mouth, promoting comfort.

In some embodiments, the teeth tray 300 is made of a material that molds to the teeth and/or contours of a user's mouth, improving comfort and/or fit. In some embodiments, the teeth tray 300 is made of a thermoplastic that the user can boil and bite to mold to the teeth and/or contours of a user's mouth. In some embodiments, the teeth tray 300 is made of a polymer, resin, plastic, sponge, food-grade polyurethane, silicone, medical-grade silicone, proprietary blends, ethylene-vinyl acetate, and/or some other suitable soft, semi-rigid, moldable, and/or rigid material.

FIG. 3F shows a back perspective view of the interchangeable mouth shield 100 in an assembled state. The mating portion 216 of the lip-anterior portion 300 is interfaced with the engagement surface 312 of the teeth tray 300. As shown in FIG. 3F, the aperture 304 is open to convey air through the interchangeable mouth shield 100.

To assemble the interchangeable mouth shield 100, the user positions the lip-anterior portion 200 anterior to the teeth tray 300, such as shown in FIG. 1B. The user rotates, for example 90 degrees, and aligns the lip-anterior portion 200 and/or the teeth tray 300 such that the mating portion 216 of the lip-anterior portion 200 is oriented to fit through the aperture 304 of the teeth tray 300. As shown in FIG. 1B, the aperture 304 can include a generally elongate shape extending transversely across an anterior surface of the teeth tray 300. The aperture 304 is capable of accommodating the elongate mating portion 216 and/or the elongate arm 215 when the lip-anterior portion 200 and/or the teeth tray 300 is rotated. The user inserts the elongate arm 215 with the mating portion 216 through the aperture 304 such that the mating portion 216 exits the aperture 304 and the elongate arm 215 is positioned within the aperture 304. The user rotates, for example back 90 degrees, and aligns the lip-anterior portion 200 with the teeth tray 300 such that the mating portion 216 interfaces with the engagement surface 312, such as shown in FIG. 3F. In some embodiments, a user applies a force to the mating portion 216 to interface with the engagement surface 312, which can result in a snap-fit and/or press-fit. In this configuration, the mating portion 216 is no longer aligned with the aperture 304 such that the lip-anterior portion 200 cannot be easily disassembled from the teeth tray 300. For example, when assembled together, mating portion 216 may be perpendicular to the aperture 304. A user can disassemble the interchangeable mouth shield 100 using similar procedures but with rotating and aligning for disengaging and extraction rather than engagement and insertion.

Figure 4A:
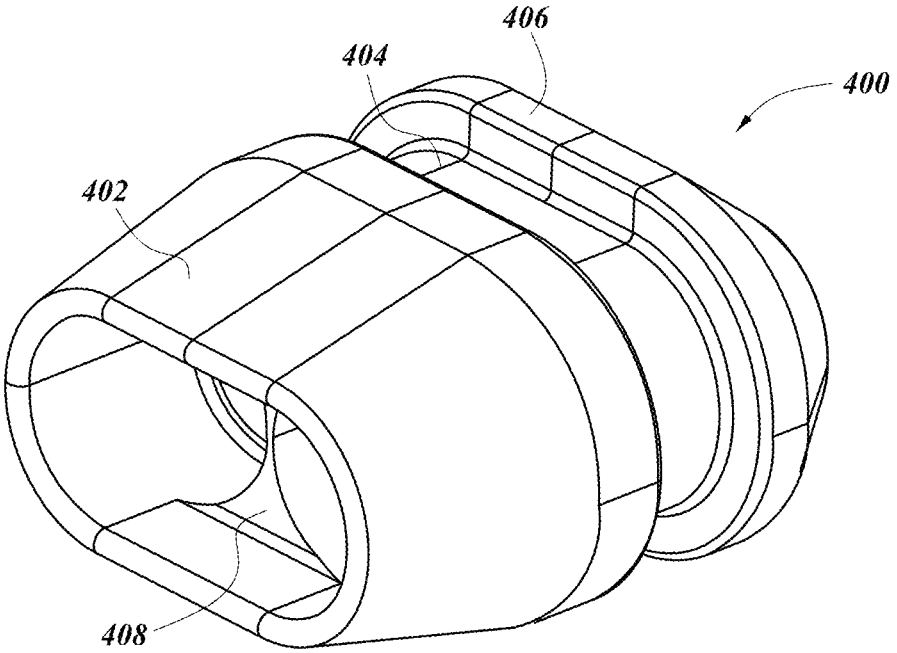
FIG. 4A illustrates a perspective view of a clip of the mouth shield shown in FIG. 1A.
Figure 4B:
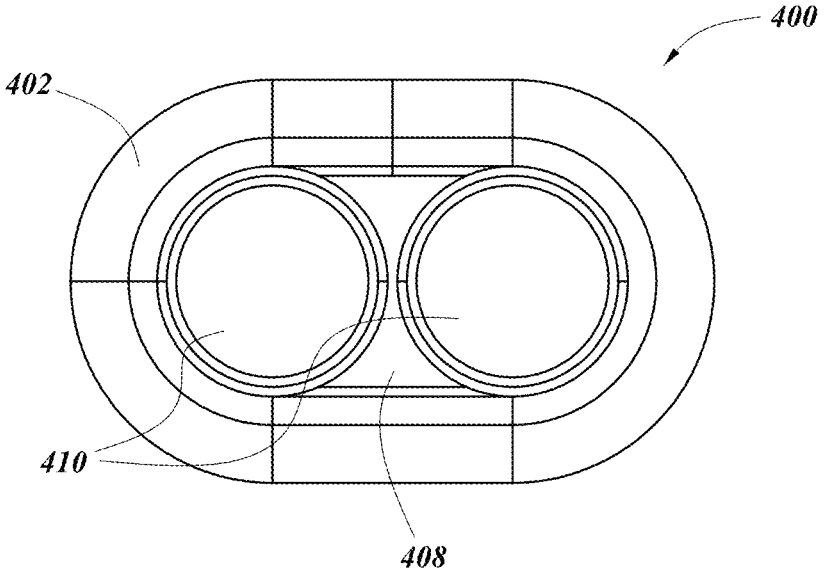
FIG. 4B illustrates a front view of the clip shown in FIG. 1A.
Figure 4C:
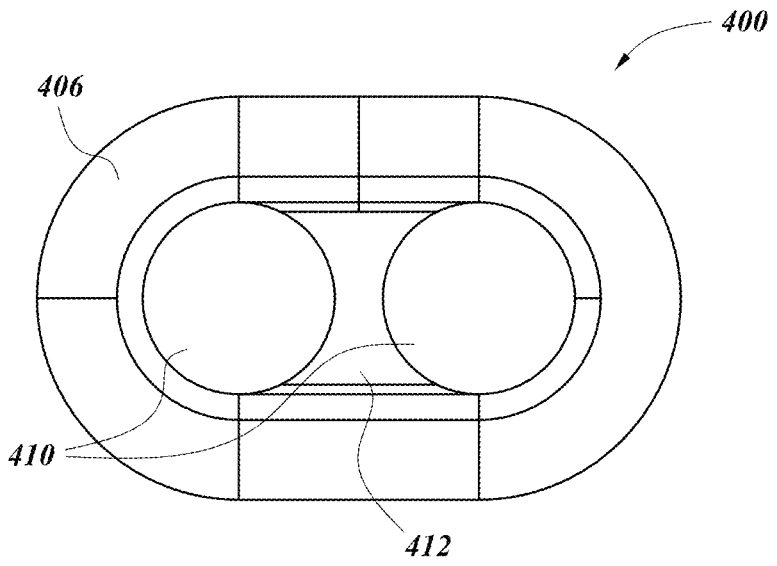
FIG. 4C illustrates a back view of the clip shown in FIG. 1A.
Figure 4D:
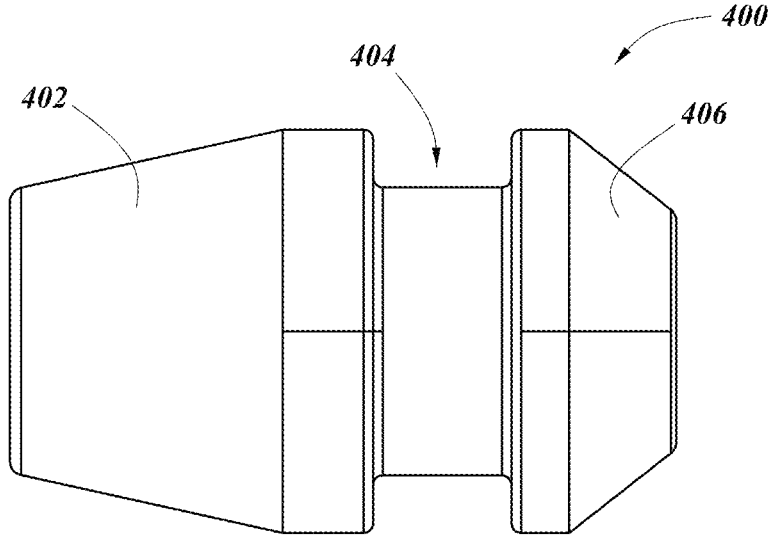
FIG. 4D illustrates a side view of the clip shown in FIG. 1A.

FIGS. 4A-4D illustrate various views of the clip 400. As shown in FIG. 4A, the clip 400 has an anterior portion 402. The anterior portion 402 is tapered in the anterior-posterior direction with a front portion of the anterior portion 402 having a smaller perimeter and/or size than a back portion. As shown in FIG. 4D, the transition from the smaller front portion of the anterior portion 402 to the larger back portion is gradual and/or angled when viewed from the side. A recess 404 is posteriorly positioned relative to the anterior portion 402. The recess 404 defines a perimeter that is smaller than the back portion of the anterior portion 402. A posterior portion 406 is positioned posterior to the recess 404. The posterior portion 406 is tapered in the posterior-anterior direction with a front portion of the posterior portion 406 having a larger perimeter and/or size than a back portion of the posterior portion 406. As shown in FIG. 4D, the transition from the larger front portion of the posterior portion 406 to the smaller back portion is gradual and/or angled when viewed from the side. The angle of the transition of the posterior portion 406 is steeper than the angle of transition of the anterior portion 402. These gradual and/or angled transitions of the anterior portion 402 and/or the posterior portion 406 can facilitate the clip 400 to interface with the receiving aperture 210 of the clip interface 206 of the lip-anterior portion 200 shown in FIG. 2A. The gradual and/or angled transitions of the anterior portion 402 and/or posterior portion 406 enable the clip 400 to be inserted into the receiving aperture 210, with gradual deflection and/or elastic deformation of the clip 200 and/or the clip-interface 206, until the receiving aperture 210 is positioned around the recess 404, securing the clip 400 into place. This interface can include forming a snap-fit or press-fit. Entering the anterior portion 402 of the clip 400 into the receiving aperture 210 can require less force than entering the posterior portion 406 given the more gradual transition of the anterior portion 402 in comparison to the posterior portion 406.

The clip 400 has an anterior offset surface 408, as shown in FIG. 4B. The anterior offset surface 408 is positioned within the anterior portion 402. The anterior offset surface 408 is posteriorly offset from the front edge of the anterior portion 402. The anterior offset surface 408 is proximate a pair of tether receiving apertures 410. The anterior offset surface 408 is positioned between the pair of tether receiving apertures 410.

The clip 400, as shown in FIG. 4C, has a posterior offset surface 412. The posterior offset surface 412 is positioned within the posterior portion 406. The posterior offset surface 412 is anteriorly offset from the back edge of the posterior portion 406. The posterior offset surface 412 is proximate a pair of tether receiving apertures 410. The posterior offset surface 412 is positioned between the pair of tether receiving apertures 410.

Referring to FIG. 4B, the pair of tether receiving apertures 410 are circular. In some embodiments, the pair of tether receiving apertures 410 are varied shapes, such as an oval, polygon, irregular, and/or other suitable shape. The pair of tether receiving apertures 410 have steps or ledges, as seen in FIG. 4B, that facilitation a reduction in the diameter of the pair of tether receiving apertures 410 from a first diameter to a second smaller diameter. The pair of tether receiving apertures 410 can receive a tether, as shown in FIG. 1A. As explained above, the clip 400 coupled to a tether can advantageously enable a user to couple the interchangeable mouth shield 100 to a component of a helmet, such as a face mask, or other object.

With reference to FIGS. 5A-5H, another interchangeable mouth shield 500 is shown. The interchangeable mouth shield 500 resembles or is identical to the interchangeable mouth shield 100 discussed above in many respects. Any component or step disclosed in any embodiment in this specification can be used in other embodiments.

Figure 5A:
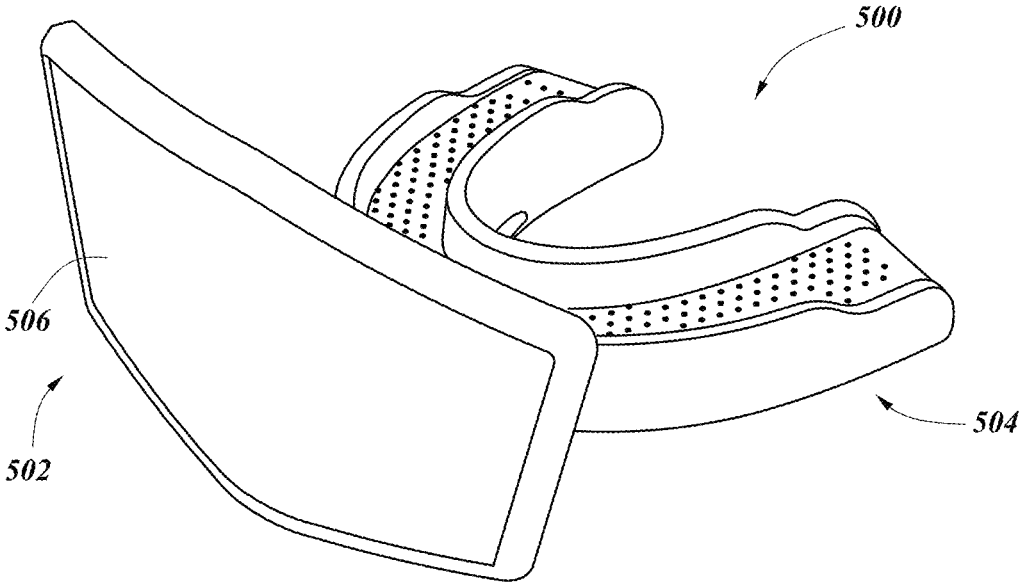
FIG. 5A illustrates a front perspective view of another interchangeable mouth shield in an assembled configuration.

As shown in FIG. 5A, the interchangeable mouth shield 500 has a lip-anterior portion 502. The interchangeable mouth shield 500 has a teeth tray 504. The lip-anterior portion 502 can releasably couple to the teeth tray 504. The lip-anterior portion 502 has a panel 506. The panel 506 can have the same or similar characteristics, features, and/or variations as those described in reference to the panel 202 above. The panel 506, as illustrated in FIG. 5A, does not have a vent aperture on a front surface like the panel 202 of the interchangeable mouth shield 100 described above. This can advantageously provide a continuous front surface, without apertures, that can be used for decorative purposes and personalization. However, as shown in FIG. 5G, other embodiments can have vent apertures, such as panels 534 and 536. The lip-anterior portion 502 does not have a lip shield as does the lip-anterior portion 200 of the interchangeable mouth shield 100 described above. However, in some embodiments, the lip-anterior portion 502 can have a separate lip shield.

Figure 5B:
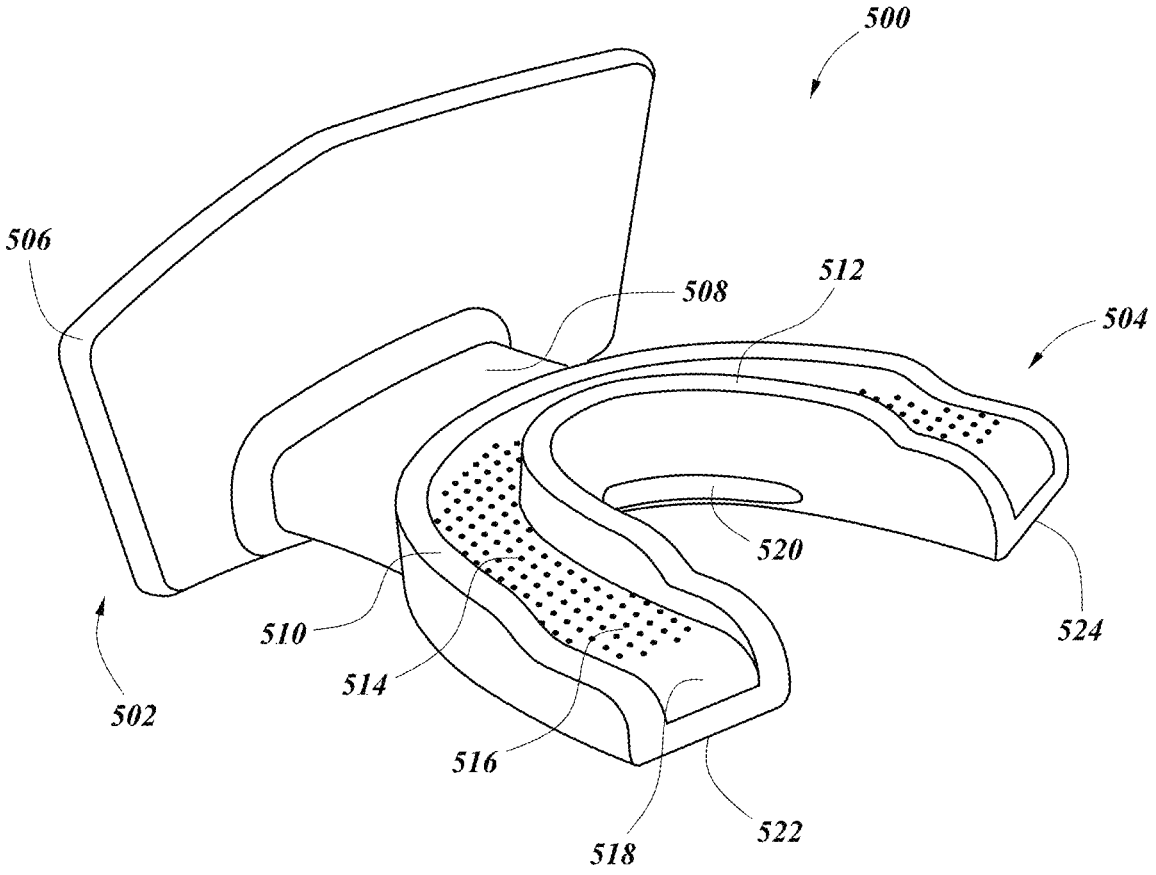
FIG. 5B illustrates a back perspective view of the interchangeable mouth shield of FIG. 5A.
Figure 5C:
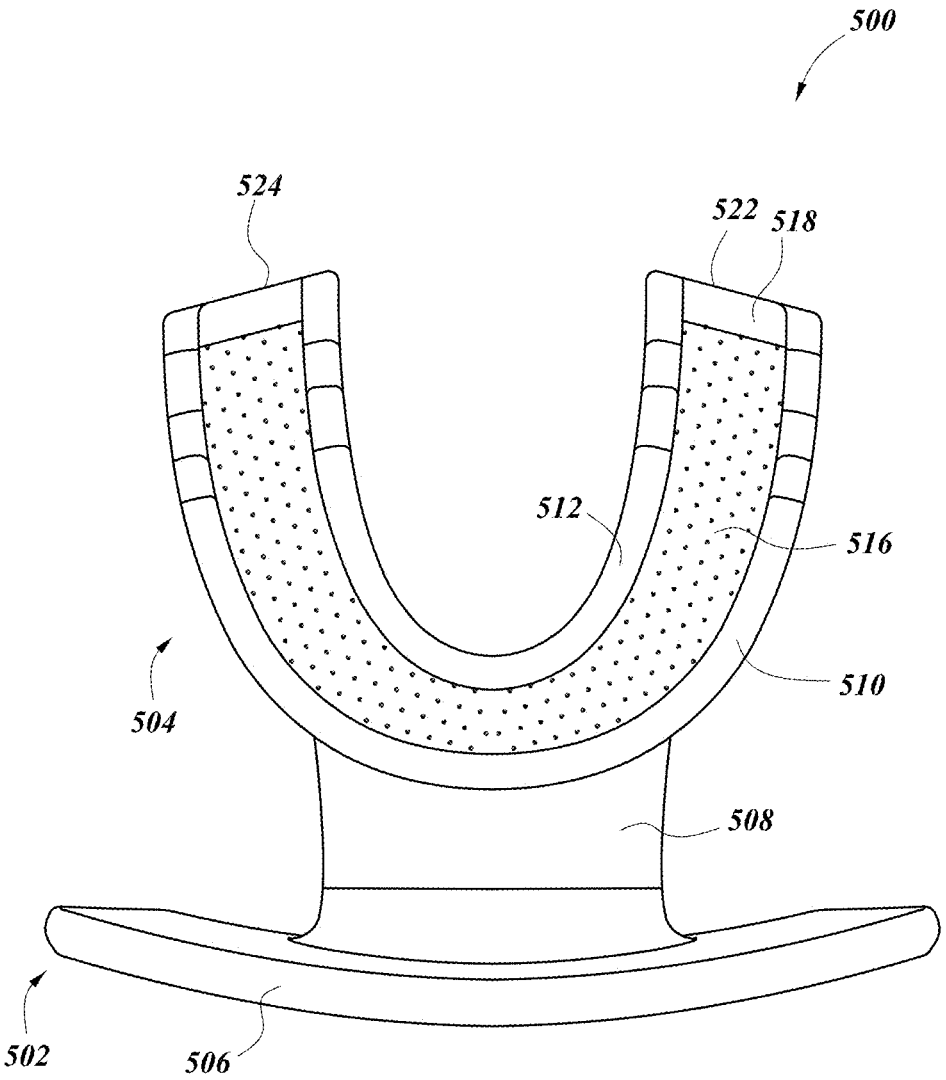
FIG. 5C illustrates a top view of the interchangeable mouth shield of FIG. 5A.
Figure 5D:
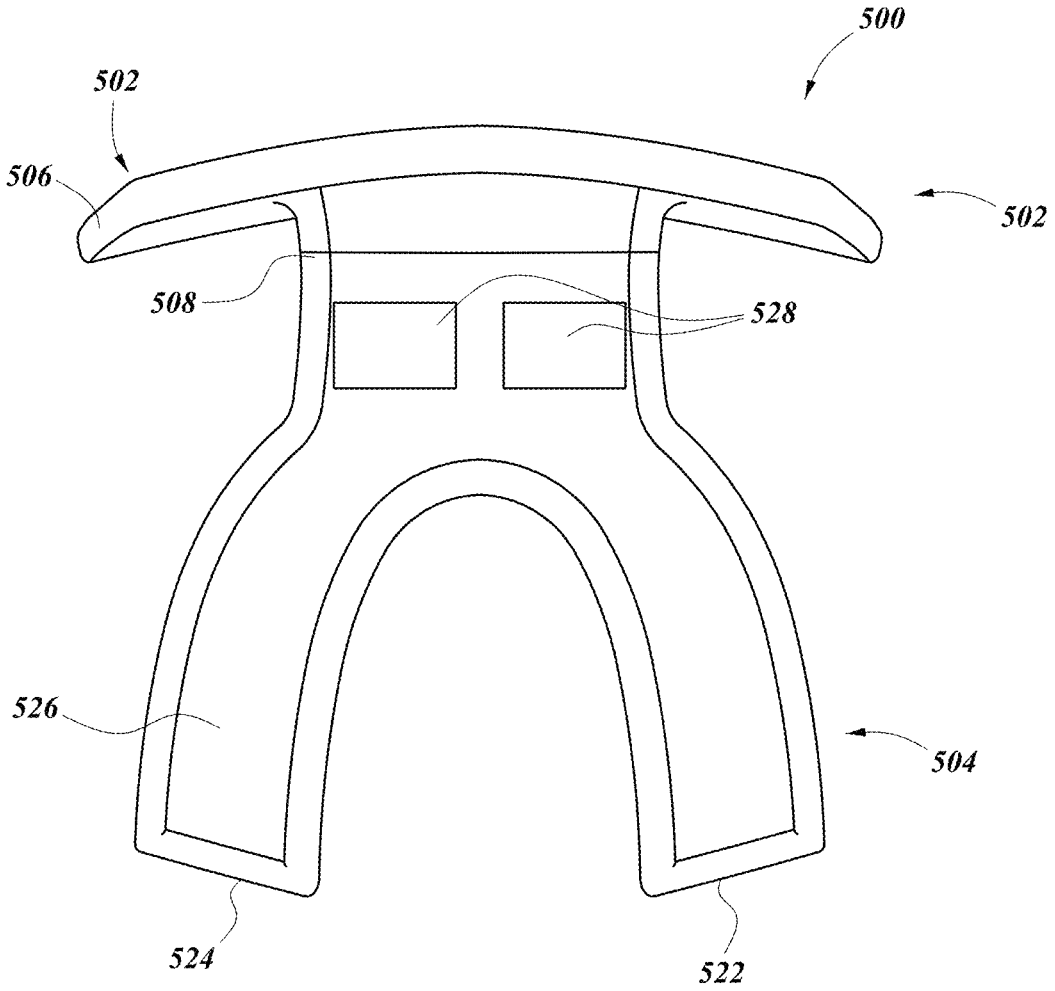
FIG. 5D illustrates a bottom view of the interchangeable mouth shield of FIG. 5A.

The teeth tray 504, as shown in FIGS. 5B and 5D, has an outer wall 510, inner wall 512, channel 514, surface 518, first end 522, second end 524, and bottom surface 526, which can all have the same characteristics, features, and/or variations of similarly named features described in reference to the interchangeable mouth shield 100 above.

The teeth tray 504 has a bite pad 516. The bite pad 516 can have all the same characteristics, features, and/or variations of the surface 314, separate bite pad, and/or integrated bite pad described above in reference to the interchangeable mouth shield 100.

As shown in FIG. 5B, the teeth tray 504 has a bridge 508. The bridge 508 extends anteriorly away from the teeth tray 504. The bridge 508 extends from at least a portion of the outer wall 510 and/or front of the teeth tray 504. The bridge 508 has a cross-section that is rectangular with rounded edges. In some embodiments, the bridge 508 has a cross-section that has a different shape, which can include a circle, oval, polygon, and/or other suitable shape. As shown in FIG. 5D, the teeth tray 504 has a pair of vent exits 528. The pair of vent exits 528 are positioned on an underside of the bridge 528. The pair of vent exits 528, when the interchangeable mouth shield 500 is assembled, are posteriorly positioned relative to the panel 506. The vent exits 528 are positioned such that the vent exits 528 are not covered by the mouth of a user during use. Positioning the vent exits 528 on an underside of the bridge 508 and posterior to the panel 506 can eliminate or reduce the amount of debris, dirt, and/or other objects that will enter the vent exits 528. This can help to reduce instances of debris, dirt, and/or other objects obstructing the vent and/or entering the user's mouth. Positioning the vent exits 528 on an underside of the bridge 508, as explained above, can provide a continuous surface on the 506 for decorative and personalization purposes. The pair of vent exits 528 are rectangles. In some embodiments, the pair of vent exits 528 are other shapes which can include a circle, oval, polygon, irregular shape, and/or any other suitable shape. The pair of vent exits 528 are the same size. In some embodiments, the pair of vent exits 528 are different sizes.

Figure 5E:
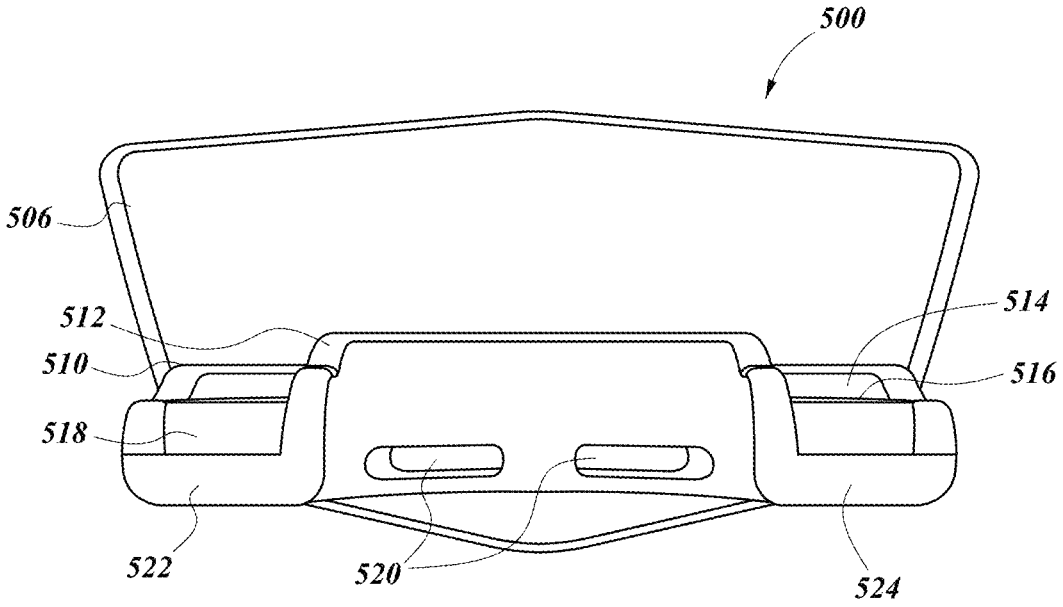
FIG. 5E illustrates a back view of the interchangeable mouth shield of FIG. 5A.

The pair of vent exits 528 are connected via a vent to a pair of vent openings 520 shown in FIG. 5E, such that air can pass through the teeth tray 504. The pair of vent openings 520 are positioned on a portion of the inner wall 512 and/or a posterior surface of the teeth tray 504. The pair of vent openings 520 are the same size. In some embodiments, the pair of vent openings 520 are different sizes. The pair of vent openings 520 are the same shape, being elongate with curves. In some embodiments, the pair of vent openings 520 are different shapes, which can include a circle, oval, polygon, irregular shape, and/or any other suitable shape.

Figure 5F:
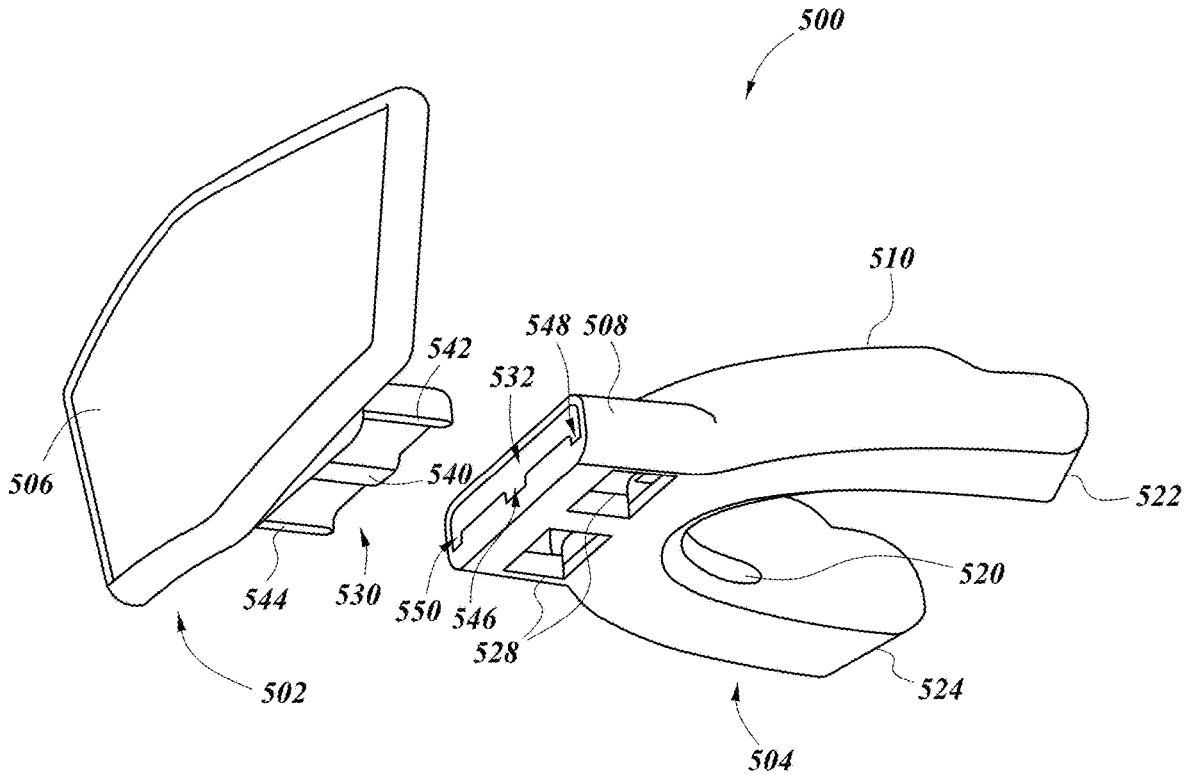
FIG. 5F illustrates a perspective view of the interchangeable mouth shield of FIG. 5A in a disassembled configuration.
Figure 5G:
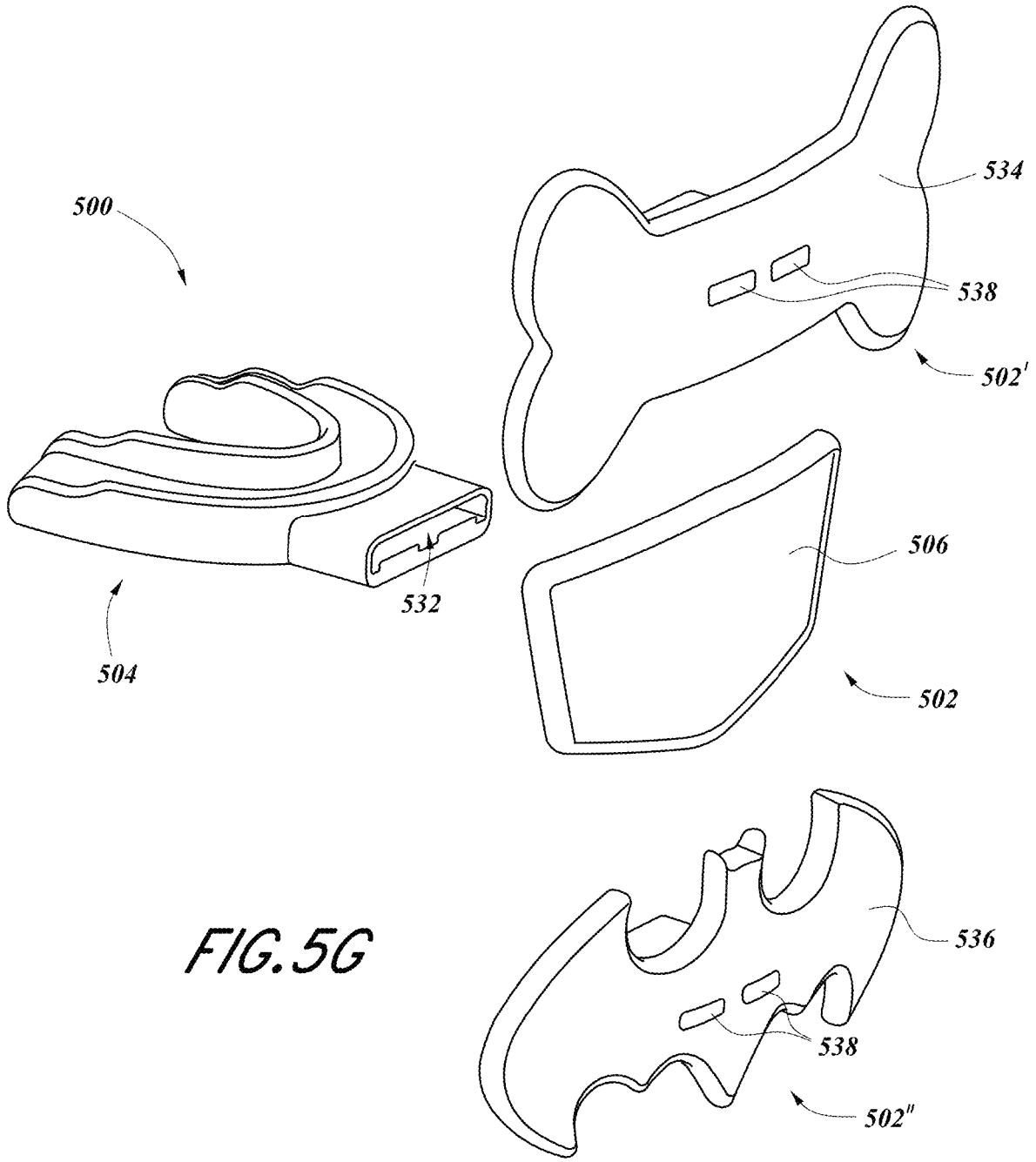
FIG. 5G illustrates a front perspective view of the interchangeable mouth shield of FIG. 5A in a disassembled configuration with a plurality of lip-anterior portions with different panels.

As shown in FIG. 5F, the lip-anterior portion 502 has a plug 530. The plug 530 has a plurality of extrusions, which include a center extrusion 540, a first periphery extrusion 542, and a second periphery extrusion 544. The center extrusion 540, first periphery extrusion 542, and second periphery extrusion 544 extend from a bottom surface of the plug 530. The center extrusion 540 is positioned between the first periphery extrusion 542 and the second periphery extrusion 544. The center extrusion 540 is larger than the first periphery extrusion 542 and the second periphery extrusion 544. The center extrusion 540, first periphery extrusion 542, and second periphery extrusion 544 can have a variety of shapes and contours, which can include curves, angled surfaces, straight surfaces, and/or other features.

The teeth tray 504, as shown in FIG. 5F, has a socket 532 in the bridge 508. The socket 532 and the plug 530 complement each other such that the plug 530 can be inserted into the socket 532 to assemble the interchangeable mouth shield 500. The socket 532 includes a plurality of grooves, which include a center groove 546, a first periphery groove 548, and a second periphery groove 550. The center groove 546, first periphery groove 548, and second periphery groove 550 are positioned on a bottom portion of the socket 532. The center groove is positioned between the first periphery groove 548 and second periphery groove 550. The center groove 546 receives the center extrusion 540. The first periphery groove 548 receives the first periphery extrusion 542. The second periphery groove 550 receives the second periphery extrusion 544. The center groove 546, first periphery groove 548, and second periphery groove 550 can have a variety of shapes and contours, which can include curves, angled surfaces, straight surfaces, and/or other features.

A user can assemble the interchangeable mouth shield 500 by positioning the lip-anterior portion 502 in front of the teeth tray 504, as shown in FIG. 5F. The user can insert the plug 530 into the socket 532 by aligning the extrusions of the plug 530 with the grooves of the socket 532 and placing the plug 530 in the socket 532. In some embodiments, the plug 530 is retained in the socket 532 with a snap-fit or press-fit. In some embodiments, the plug 530 is retained in the socket 532 with friction. A user can disassemble the interchangeable mouth shield 500 by pulling the lip-anterior portion 502 and teeth tray 504 away from each other. In some embodiments, the user can use the teeth tray 504 without coupling to the lip-anterior portion 502.

Figure 5H:
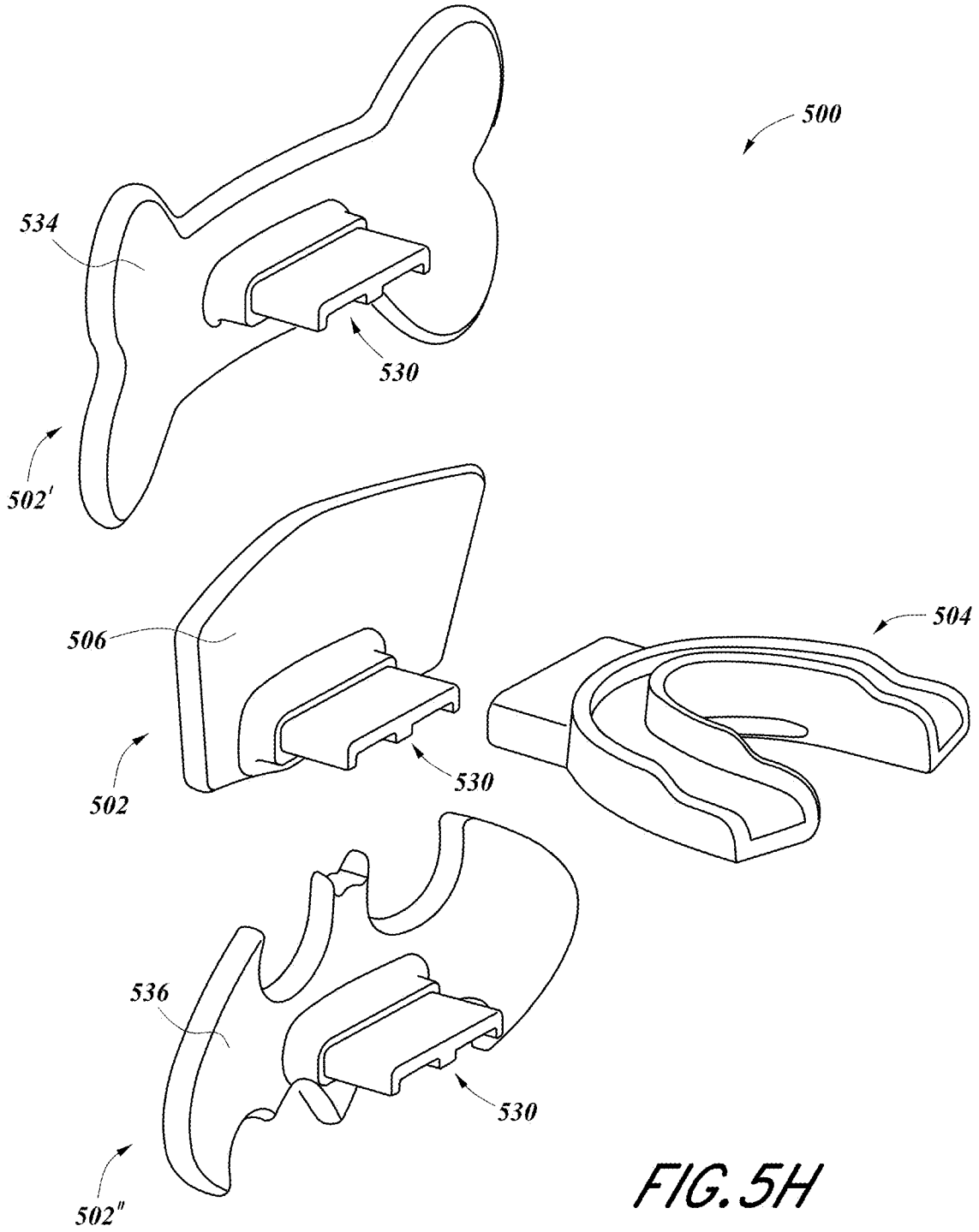
FIG. 5H illustrates a back perspective view of the interchangeable mouth shield of FIG. 5A in a dissembled configuration with a plurality of lip-anterior portions with different panels.

FIGS. 5G and 5F show a lip-anterior portion 502' and lip-anterior portion 502", variants of lip-anterior portion 502. The lip-anterior portion 502' includes a panel 534 that is shaped like a bone. The lip-anterior portion 502" includes a panel 536 that is shaped like a bat. The panel 534 and panel 536 vary from the panel 506 that is shaped like a shield. These are merely examples that illustrate that the panel 506, or other panels described herein, can have varying shapes. The lip-anterior portion 502, lip-anterior portion 502', and lip-anterior portion 502", as seen in FIG. 5H all have the same plug 530. This enables a user to use any of the lip-anterior portion 502, lip-anterior portion 502', and lip-anterior portion 502" when using the interchangeable mouth shield 500. This advantageously enables a user to change the style and/or size of a panel 506. In some embodiments, the interchangeable mouth guard 500, or others described herein, are manufactured or assembled into kits that come with a plurality of lip-anterior portions, each having a differently styled and/or sized panel. This advantageously enables customization and personalization.

Figure 6A:
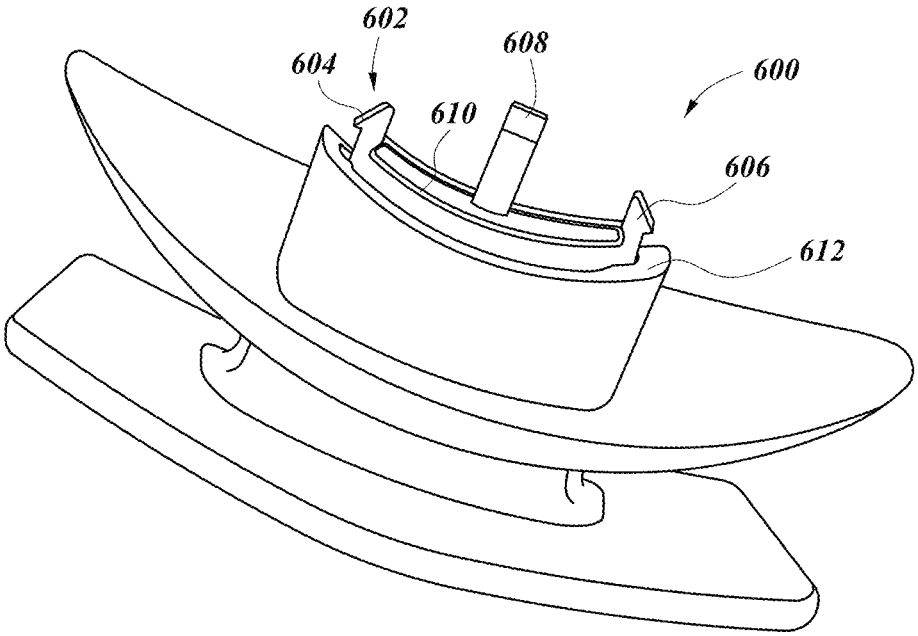
FIG. 6A illustrates a perspective view of another lip-anterior portion.
Figure 6B:
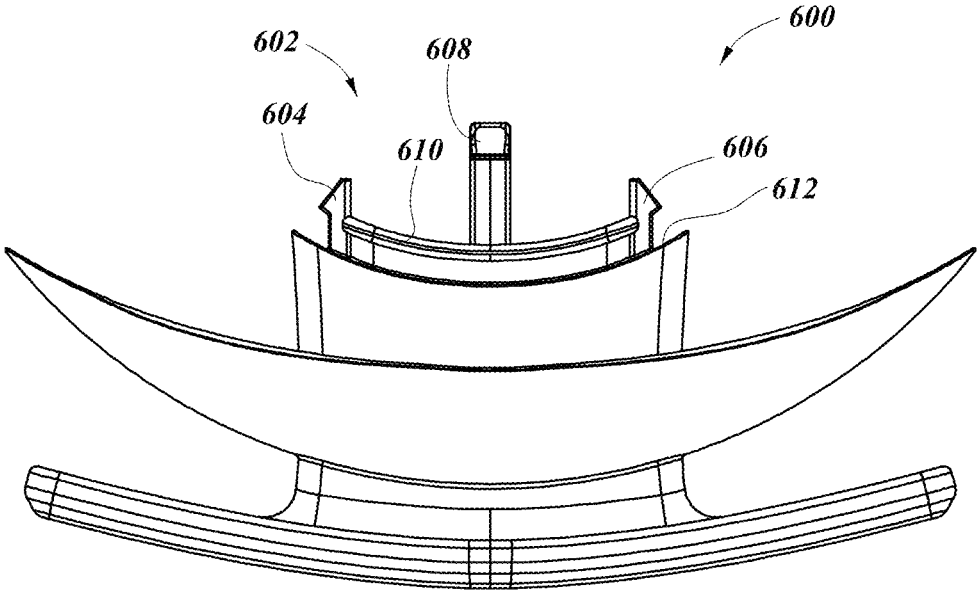
FIG. 6B illustrates a top view of the lip-anterior portion of FIG. 6A.
Figure 6C:
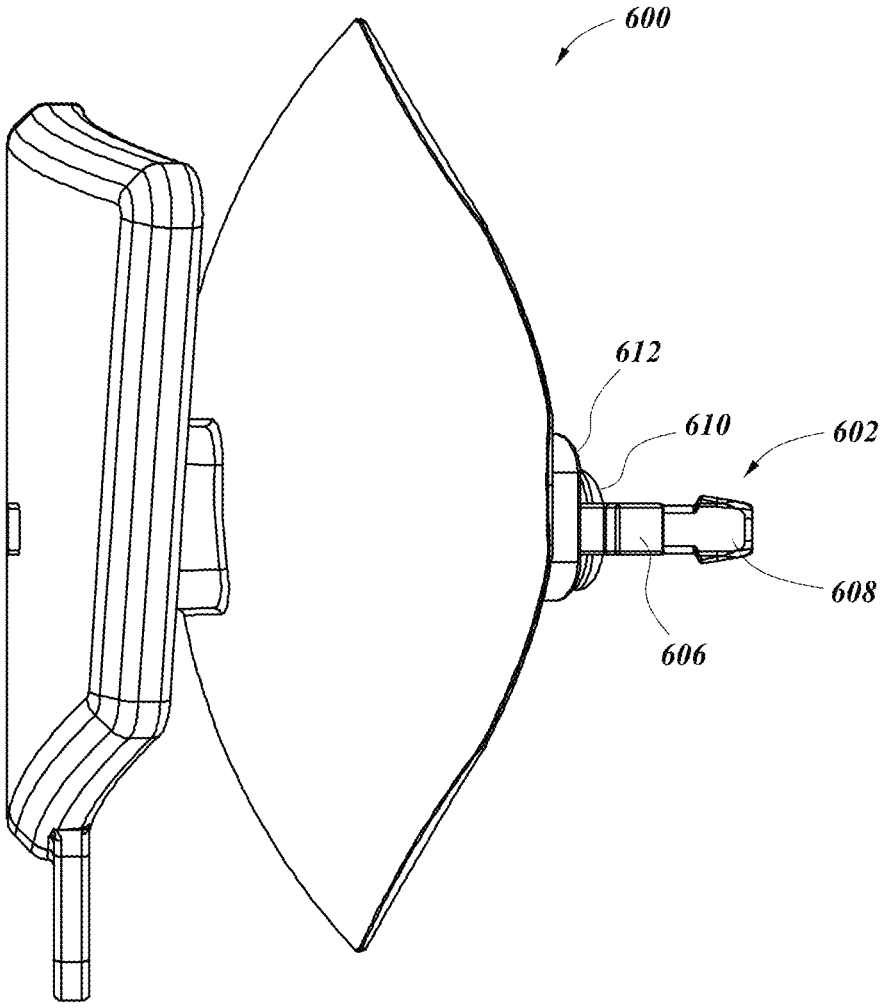
FIG. 6C illustrates a side view of the lip-anterior portion of FIG. 6A.

With reference to FIGS. 6A-6C, another lip-anterior portion 600 is shown. The lip-anterior portion 600 resembles or is identical to the lip-anterior portion 200 discussed above except that the features that interface with a teeth tray are different. Accordingly, only the features of the lip-anterior portion 600 that are different than the lip-anterior portion 200 or necessary for explanation are numbered. Any component or step disclosed in any embodiment in this specification can be used in other embodiments.

The lip-anterior portion 600 has an engagement portion 602, as shown in FIG. 6A. The engagement portion 602 is positioned on a posterior portion of the lip-anterior portion 600. The engagement portion 602 includes a contact surface 612. The contact surface 612 can have the same or similar characteristics, features, and/or variations as those described in reference to the contact surface 214 of the interchangeable mouth shield 100 described above.

As shown in FIG. 6A, the engagement portion 602 includes an extrusion 610. The extrusion 610 extends away from the contact surface 612. The extrusion 610, as shown in FIG. 6B, has a curved free end that has a radius of curvature that is the same as or similar to the radius of curvature of the contact surface 612. As shown in FIG. 6A, the extrusion 610 does not extend beyond the perimeter of the contact surface 612. The extrusion 610 has a shape that is similar to the contact surface 612. The extrusion 610 has an aperture or apertures that enable a vent to extend through the entirety of the lip-anterior portion 600.

The engagement portion 602 has a plurality of arms that posteriorly extends away from the lip-anterior portion 600, which include a central arm 608, first peripheral arm 604 and second peripheral arm 606. The central arm 608 is positioned between the first peripheral arm 604 and second peripheral arm 606. The central arm 608, first peripheral arm 604, and second peripheral arm 606 each have hook(s), edge(s) and/or ridge(s) to facilitate coupling. The center arm 608 is longer than the first peripheral arm 604 and second peripheral arm 606. In some embodiments, the central arm 608, first peripheral arm 604, and second peripheral arm 606 are the same length and/or all different. The center arm 608 extends from within the extrusion 610. The first peripheral arm 604 and second peripheral arm 606 are the same size and shape. The first peripheral arm 604 and second peripheral arm 606 are positioned at opposite peripheries of the extrusion 610.

In some embodiments, the engagement portion 602 can include less than three arms or more than three arms. In some embodiments, the engagement portion 602 can include other coupling mechanisms such as a threaded extrusion or other suitable features.

With reference to FIGS. 7A-7D, another teeth tray 700 is shown. The teeth tray 700 resembles or is identical to the teeth tray 300 discussed above except that the features that interface with a lip-anterior portion are different. Accordingly, only the features of the teeth tray 700 that are different than the teeth tray 300 or necessary for explanation are numbered. Any component or step disclosed in any embodiment in this specification can be used in other embodiments.

Figure 7A:
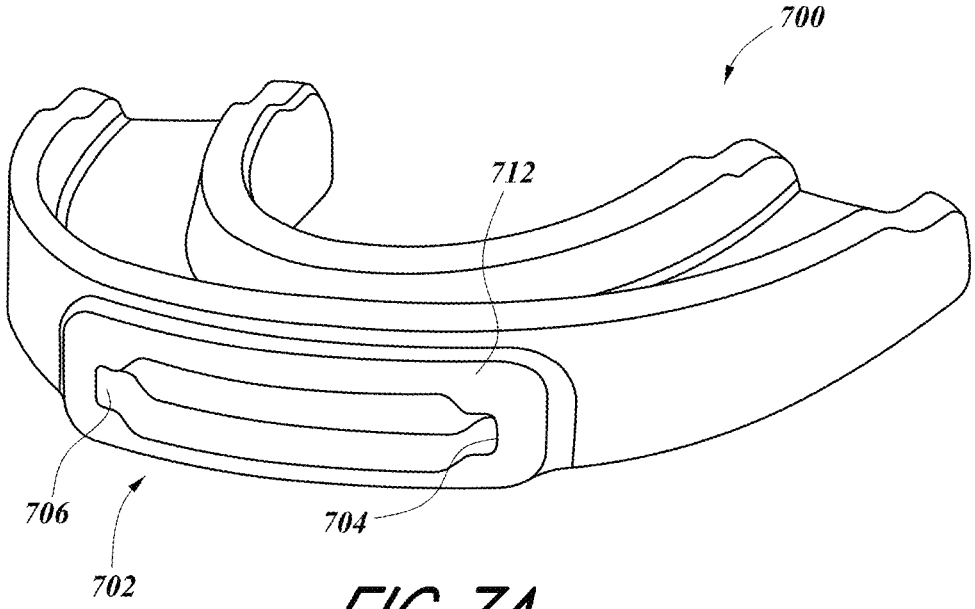
FIG. 7A illustrates a perspective view of another teeth tray.
Figure 7B:
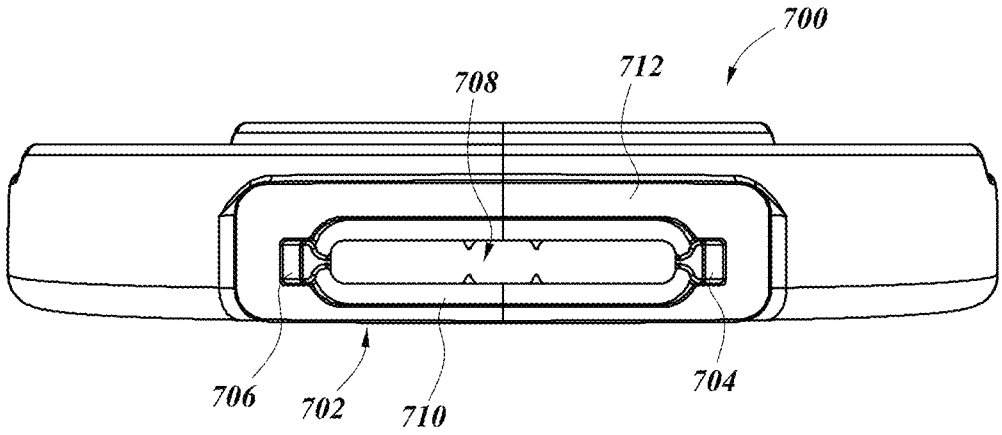
FIG. 7B illustrates a front view of the teeth tray of FIG. 7A.
Figure 7C:
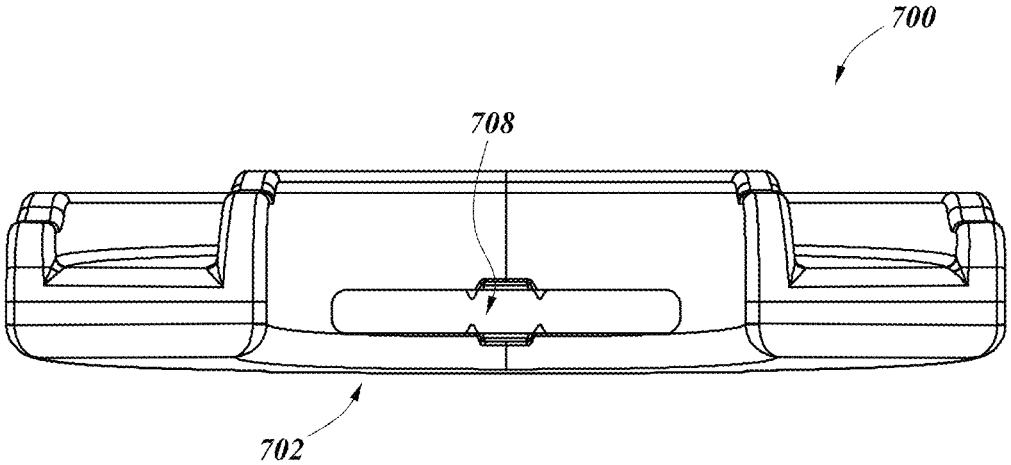
FIG. 7C illustrates a back view of the teeth tray of FIG. 7A.
Figure 7D:
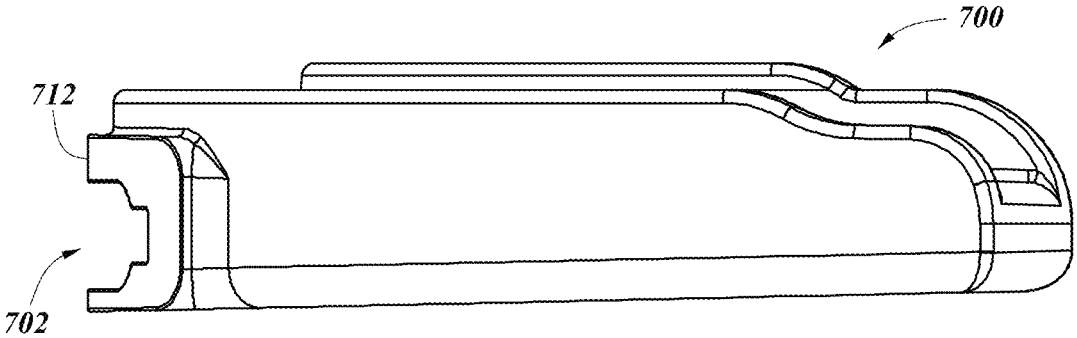
FIG. 7D illustrates a side view the teeth tray of FIG. 7A.

As shown in FIG. 7B, the teeth tray 700 has a receiving surface 712. The receiving surface 712 can have the same or similar characteristics, features, and/or variations as those described in reference to the receiving surface 302 of the interchangeable mouth shield 100 described above. The receiving surface 712, when the lip-anterior portion 600 and the teeth tray 700 are assembled, contacts the contact surface 612, which can include being flush with each other. The receiving surface 712 surrounds an engagement aperture 702. The engagement aperture 702 is sized and configured to receive the engagement portion 602 of the lip-anterior portion 600 to facilitate assembly. As shown in FIG. 7B, the engagement aperture 702 includes various engagement features extending from the walls of the engagement aperture 702, which include a central engagement region 708, a first peripheral engagement surface 704, and a second peripheral engagement surface 706. The central engagement region 708 includes a plurality of engagement extrusions that extend from the walls of the engagement aperture 702. The engagement extrusions of the central engagement region 708 can deflect upon insertion of the end portion of the central arm 608 to facilitate a snap-fit connection with the hook(s), edge(s) and/or ridge(s) of the central arm 608. The first peripheral engagement surface 704 and second peripheral engagement surface 706 are positioned at opposite peripheries of the engagement aperture 702. The first peripheral engagement surface 704 and second peripheral engagement surface 706 each have edges and and/or ridges to receive the hook(s), edge(s) and/or ridge(s) of the first peripheral arm 604 and second peripheral arm 606, respectively, to form a snap-fit connection.

An offset surface 710, as shown in FIG. 7B, is positioned within the engagement aperture 702. The offset surface 710 reduces the size of the engagement aperture 702. The offset surface 710 contacts the free end of the extrusion 610 when the lip-anterior portion 600 is assembled with the teeth tray 700.

A user can interface the lip-anterior portion 600 to the teeth tray 700 by positioning the lip-anterior portion 600 anterior to the teeth tray 700. The user can align the engagement portion 602 with the engagement aperture 702 and insert the engagement portion 602 into the engagement aperture 702. The deflection and recovery of the central arm 608, first peripheral arm 604, and/or the second peripheral arm 606 can cause a snap-fit connection to form, respectively, between the central arm 608, first peripheral arm 604, and second peripheral arm 606 and the central engagement region 708, first peripheral engagement surface 704, and second peripheral engagement surface 706. A user can decouple the lip-anterior portion 600 from the teeth tray 700 by deflecting the central arm 608, first peripheral arm 604, and/or the second peripheral arm 606 from the posterior side of the teeth tray 700 and pulling apart the lip-anterior portion 600 and the teeth tray 700.

The components, features, and/or devices disclosed herein can be made of a variety of materials that can include a polymer, resin, plastic, sponge, food-grade polyurethane, silicone, medical-grade silicone, proprietary blends, ethylene-vinyl acetate, and/or some other suitable soft, semi-rigid, moldable, and/or rigid material.

As used herein, the relative terms "anterior" and "posterior" shall be defined from the perspective of the mouth shield. Thus, anterior refers to the direction of the lip side of the mouth shield and posterior refers to the direction of the teeth side of the mouth shield.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The term "substantially" as used herein represent an amount close to the stated amount that still performs a desired function or achieves a desired result. For example, the term "substantially" may refer to an amount that is within less than 10% of the stated amount. As another example, in certain embodiments, the term "substantially flat" refers to a value, amount, or characteristic that departs from exactly flat by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

Any methods disclosed herein need not be performed in the order recited. The methods disclosed herein include certain actions taken by a practitioner; however, they can also include any third-party instruction of those actions, either expressly or by implication. For example, actions such as "rotating a proximal end of the shaft member to rotate the end effector" include "instructing rotation of a proximal end of the shaft member to rotate the end effector."

The following is claimed:

1. An interchangeable mouth shield for physical activities, the interchangeable mouth shield comprising:

an anterior portion comprising:

a panel having a posterior side, an anterior side, and an outer periphery, the anterior side defining an anterior-most surface of the interchangeable mouth shield;

a lip shield comprising an outer periphery, the lip shield posteriorly positioned relative to the posterior side of the panel such that the outer periphery of the panel and the outer periphery of the lip shield are spaced apart from each other by an interrupted gap, the lip shield configured to be disposed outside of and around a mouth of a user to protect lips of the user, wherein the lip shield extends beyond the outer periphery of the panel when viewed from an anterior perspective, and wherein an entirety of the panel is disposed more anterior than an entirety of the lip shield;

a connector portion extending from the posterior side of the panel to an anterior surface of the lip shield;

and a bridge that posteriorly extends away from the lip shield to a free end, the free end comprising a posterior-facing contact surface and openings on each side of an engagement arm;

a teeth tray comprising:

an outer wall, an inner wall, an anterior-facing receiving surface, an aperture in the anterior-facing receiving surface, and a channel, wherein the outer wall is offset from the inner wall such that the channel for receiving teeth of the user extends between the outer wall and the inner wall;

wherein the anterior portion and the teeth tray are configured to be releasably coupled together such that the outer wall of the teeth tray is posterior to the lip shield with the posterior-facing contact surface of the free end of the bridge contacting the anterior-facing receiving surface of the teeth tray positioned around the aperture such that the openings of the bridge are aligned with the aperture of the teeth tray when the engagement arm extends through the aperture to enable the user to breathe through the interchangeable mouth shield.

2. The interchangeable mouth shield of claim 1, wherein the lip shield curves posteriorly such that it is configured to contact portions of the user surrounding the mouth of the user.

3. The interchangeable mouth shield of claim 1, wherein the outer periphery of the panel is polygonal shaped.

4. The interchangeable mouth shield of claim 1, wherein the engagement arm is connected to and extends posteriorly from a posterior surface of the anterior portion, the engagement arm configured to facilitate the releasable coupling of the anterior portion and the teeth tray.

5. An interchangeable mouth shield for physical activities, the interchangeable mouth shield comprising:

an anterior portion comprising:

a panel having a posterior side, an anterior side, and an outer periphery;

a lip shield comprising an outer periphery, the lip shield posteriorly positioned relative to the posterior side of the panel such that the outer periphery of the panel and the outer periphery of the lip shield are spaced apart from each other by an interrupted gap, the lip shield configured to be disposed outside of and around a mouth of a user to protect lips of the user; and a bridge that posteriorly extends away from the lip shield to a free end, the free end comprising a posterior-facing contact surface and openings on each side of an engagement arm;

a teeth tray comprising:

an outer wall, an inner wall, an aperture, and a channel, wherein the outer wall is offset from the inner wall such that the channel for receiving teeth of the user extends between the outer wall and the inner wall;

wherein the anterior portion and the teeth tray are configured to be releasably coupled together such that the outer wall of the teeth tray is posterior to the lip shield with the posterior-f acing contact surface of the free end of the bridge contacting an anterior-facing surface of the teeth tray to space the lip shield away from the teeth tray, wherein the openings of the bridge are aligned with the aperture of the teeth tray when the engagement arm extends through the aperture to enable the user to breathe through the interchangeable mouth shield.

6. The interchangeable mouth shield of claim 5, wherein the lip shield extends beyond the outer periphery of the panel when viewed from an anterior perspective.

7. The interchangeable mouth shield of claim 5, wherein the outer periphery of the lip shield extends beyond lateral edges of the panel when viewed from an anterior perspective.

8. The interchangeable mouth shield of claim 5, wherein the anterior side defines an anterior-most surface of the interchangeable mouth shield.

9. The interchangeable mouth shield of claim 5, wherein the lip shield curves posteriorly such that it is configured to contact portions of the user surrounding the mouth of the user.

10. The interchangeable mouth shield of claim 5, wherein the outer periphery of the panel is polygonal shaped.

11. The interchangeable mouth shield of claim 5, wherein the anterior portion comprises a connector portion between the posterior side of the panel and the lip shield, the connector portion offsetting the posterior side of the panel from the lip shield.

12. The interchangeable mouth shield of claim 5, wherein the engagement arm is connected to and extends posteriorly from a posterior surface of the anterior portion, the engagement arm configured to facilitate the releasable coupling of the anterior portion and the teeth tray.

* * * * *